US011933304B2

(12) United States Patent
Flanigan

(10) Patent No.: US 11,933,304 B2
(45) Date of Patent: Mar. 19, 2024

(54) SCROLL COMPRESSOR INCLUDING HUB LUBRICANT PASSAGE

(71) Applicant: BITZER Kuehlmaschinenbau GmbH, Sindelfingen (DE)

(72) Inventor: Paul J. Flanigan, Cicero, NY (US)

(73) Assignee: BITZER KUEHLMASCHINENBAU GMBH, Sindelfingen (DE)

( * ) Notice: Subject to any disclaimer, the term of this patent is extended or adjusted under 35 U.S.C. 154(b) by 0 days.

(21) Appl. No.: 17/465,109

(22) Filed: Sep. 2, 2021

(65) Prior Publication Data

US 2023/0060653 A1 Mar. 2, 2023

(51) Int. Cl.

| | |
|---|---|
| ***F04C 29/02*** | (2006.01) |
| ***F01C 21/04*** | (2006.01) |
| ***F04C 18/02*** | (2006.01) |

(52) U.S. Cl.

CPC ..... *F04C 29/02* (2013.01); *F01C 21/04* (2013.01); *F04C 18/0215* (2013.01); *F04C 29/023* (2013.01); *F04C 18/0253* (2013.01); *F04C 2240/50* (2013.01); *F04C 2240/56* (2013.01); *F04C 2240/603* (2013.01)

(58) Field of Classification Search

CPC .... F04C 29/02; F04C 18/0215; F04C 29/023; F04C 18/0253; F04C 2240/50; F04C 2240/56; F04C 2240/603; F01C 21/04

See application file for complete search history.

(56) References Cited

U.S. PATENT DOCUMENTS

| | | | | |
|---|---|---|---|---|
| 4,575,320 | A | 3/1986 | Kobayashi et al. | |
| 4,609,334 | A * | 9/1986 | Muir | F04C 23/008 418/55.6 |
| 4,637,786 | A | 1/1987 | Matoba et al. | |

(Continued)

FOREIGN PATENT DOCUMENTS

| | | | | |
|---|---|---|---|---|
| CN | 212536075 U | * | 2/2021 | |
| EP | 972943 A2 | * | 1/2000 | F04C 27/005 |
| EP | 3438457 A1 | | 6/2019 | |

(Continued)

OTHER PUBLICATIONS

English Machine Translation of KR 10-2005-0060336A via USPTO PE2E system (Year: 2005).*

(Continued)

*Primary Examiner* — Dominick L Plakkoottam
*Assistant Examiner* — Paul W Thiede
(74) *Attorney, Agent, or Firm* — Reinhart Boerner Van Deuren P.C.

(57) ABSTRACT

A scroll compressor includes two scroll bodies each having a scroll rib. The scroll ribs engage each other to form at least one compression chamber. The scroll compressor further comprises a drive shaft for driving a moveable scroll body of the two scroll bodies. The moveable scroll body includes a base plate which has two opposing sides. On a first side of the two opposing sides, the scroll rib is arranged, and on a second side of the two opposing sides a hub is arranged. The hub has a receiving portion for a drive section of the drive shaft. The moveable scroll body has at least one passage from an interior of the receiving portion to a hub environment located around the hub at the second side of the two opposing sides.

23 Claims, 7 Drawing Sheets

FIG. 4

(56) References Cited

U.S. PATENT DOCUMENTS

| | | | | |
|---|---|---|---|---|
| 6,149,413 | A * | 11/2000 | Lifson | F04C 27/005 418/55.6 |
| 10,197,059 | B2 | 2/2019 | Rood et al. | |

FOREIGN PATENT DOCUMENTS

| | | | | |
|---|---|---|---|---|
| JP | H01290984 | A | | 11/1989 |
| KR | 1020050060336 | A | * | 6/2005 |
| KR | 100575697 | B1 | | 5/2006 |
| WO | WO 2016/125228 | A1 | | 8/2016 |
| WO | WO 2016/189738 | A1 | | 12/2016 |
| WO | WO 2017/168673 | A1 | | 10/2017 |
| WO | WO 2019/155572 | A1 | | 8/2019 |
| WO | WO-2020143350 | A1 | * | 7/2020 |
| WO | WO 2022/021644 | A1 | | 2/2022 |

OTHER PUBLICATIONS

English Machine Translation of WO2020143350A1 via USPTO Fit Database on Sep. 3, 2023 (Year: 2020).*
English Machine Translation of CN212536075U via USPTO Fit Database on Sep. 3, 2023 (Year: 2021).*
English Machine Translation of WO2017168673A1 (translated by USPTO Fit Database on Nov. 16, 2023) (Year: 2017).*

* cited by examiner

SCROLL COMPRESSOR INCLUDING HUB LUBRICANT PASSAGE

FIELD OF THE INVENTION

The invention relates to a scroll compressor comprising two scroll bodies.

BACKGROUND OF THE INVENTION

The problem underlying the invention is to improve the functioning of the scroll compressor.

SUMMARY OF THE INVENTION

According to one aspect of the invention this problem is solved by a scroll compressor which comprises two scroll bodies each having a scroll rib and the scroll ribs engage each other to form at least one compression chamber and the scroll compressor further comprises a drive shaft for driving a moveable scroll body of the two scroll bodies. The moveable scroll body comprises a base plate which has two opposing sides wherein on a first side of the two opposing sides the scroll rib of the moveable scroll body is arranged and on a second side of the two opposing sides a hub is arranged with the hub comprising a receiving portion for a drive section of the drive shaft, and wherein the moveable scroll body comprises at least one passage from an interior of the receiving portion to a hub environment located around the hub at the second side of the two opposing sides.

Accordingly, the moveable scroll body has at least one passage which in particular fluidly connects the interior of the receiving portion of the hub with the hub environment and for example an advantage of an embodiment of the invention is that a lubricant provided to the interior of the receiving portion is enabled to flow through the passage directly to the hub environment in particular for lubricating parts of the compressor in the hub environment, preferably a bearing for the moveable scroll body, advantageously a thrust bearing providing axial support for the moveable scroll body.

Preferably, at least in some embodiments, provision of lubricant to at least one bearing, in particular a bearing supporting the moveable scroll body, is enhanced by the passage and thus wear is reduced and a reliability of the scroll compressor is improved.

For example, the lubricant comprises an oil. In particular, the lubricant comprises a mixture of an oil and a refrigerant.

In particular, the hub environment is defined adjacently to the second side of the moveable scroll body and radially surrounds the hub.

In some advantageous embodiments the moveable scroll body comprises exactly one fluid passage.

For example, therewith the advantage for providing lubricant in an improved manner to the hub environment can be realized in a cost efficient manner.

In other preferred embodiments the moveable scroll body comprises several fluid passages.

In particular, lubricant is enabled by the several fluid passages to reach several area of the hub environment more easily and for example a more regular lubrication is achieved and/or spots requiring lubrication are better supplied with lubricant.

Further details with resect to the one passage or the several passages have not been given so far.

In the following the term at least one passage or the passage in connection with a feature is to be understood that in preferred embodiments the one passage or one of the several passages has that feature or that at least some, for example all, of the several passages have that feature.

In particular, at least one passage has an inlet connecting fluidly the interior of the receiving portion with the passage.

In particular, at least one passage has an outlet connecting fluidly the passage with the hub environment.

Preferably the passage is a fluid passage which extends from its inlet to its outlet and therefore in particular enables lubricant to flow out of the interior of the receiving portion to the hub environment.

With respect to the inlet no further details have been given so far.

In preferred embodiments, the inlet can be provided at different positions within the interior of the receiving portion.

Preferably, the receiving portion has an opening for receiving at least part of the drive section, and the interior of the receiving portion extends axially along an axis of the receiving portion from the opening to a bottom of the receiving portion.

In particular, the opening for receiving at least a part of the drive section is arranged at an opening side of the hub.

In particular, at the bottom of the receiving portion a bottom surface is provided, which preferably is, with respect to the axis of the receiving portion, axially directed and faces towards the opening of the receiving portion.

In particular, the axis of the receiving portion and a central axis of the scroll body at least approximately coincide.

In preferred embodiments the inlet is in axial direction closer to the bottom of the interior of the receiving portion than to the opening of the receiving portion.

Preferably, the inlet is provided in an end region of the interior of the receiving portion. The end region is opposite, in particular in axial direction of the axis of the receiving portion, to the opening of the receiving portion for a shaft.

For example, therewith lubricant provided to the bottom of the receiving portion, for example to a receiving chamber formed between the bottom surface of the receiving portion and an axial end of the drive section engaging in the receiving portion and directed to the bottom surface, is enabled to directly enter the inlet without prior being used at least temporarily as lubricant for a rotary bearing of the shaft and/or without passing a too long way along the shaft and therefore a feeding of the passage with lubricant is enhanced.

In particular, in an operational state of the compressor the bottom of the receiving portion is located higher than the opening of the receiving portion with respect to the direction of gravity and therefore with the inlet being closer to the bottom of the receiving portion the inlet is located higher with respect to the direction of gravity and lubricant may flow through the passage driven by a centrifugal force exerted by the drive shall and for example by a pressure in the receiving chamber and assisted by gravity.

In particular, in the operational state, the compressor is oriented for a proper and appropriate operation.

In particular, in the operational state, the compressor is mounted on a ground with a horizontal plane and an axis of the shaft is at least approximately perpendicular orientated to the plane of the ground and/or the axis of the shaft is oriented at least approximately parallel to a direction of gravity.

Advantageously, in the operational state of the compressor a lubricant sump of the compressor is located at a lowest part of the compressor with respect to the direction of gravity.

For example, an extension of the end region of the interior of the receiving portion, is less than 50% of the entire axial extension thereof, preferably is less than 30% of the entire axial extension thereof, for example is less than 20% of the entire axial extension thereof.

In advantageous embodiments the inlet is provided at an end of the interior of the receiving portion which is, in particular in the axial direction of the axis of the receiving portion, opposite to the opening of the receiving portion for a shaft.

For example therewith the provision of lubricant to the passage is further enhanced.

In particular, a position of the inlet at the end of the interior is located such that the axial end of the engaging part of the drive section does not reach the end of the interior and therefore the inlet is not covered by the engaging part.

In some advantageous embodiments the inlet is provided at the bottom of the receiving portion.

Preferably, the inlet of the passage is arranged adjacent to the bottom surface of the receiving portion.

Advantageously, the passage exits the interior of the receiving portion inclined to a radial direction at the inlet, in particular inclined to a radial direction with respect to an axis of the receiving portion and/or with respect to a central axis of the moveable scroll body.

In particularly preferred embodiments, at the inlet the passage exits radially the interior of the receiving portion.

In particular, the passage exits the interior radially at least approximately with respect to the axis of the receiving portion and/or with respect to the central axis of the scroll body.

In particular the moveable scroll body is orbiting during operation of the compressor and advantageously associated centrifugal forces push the lubricant into the radially exiting fluid passage.

Preferably, the inlet of the passage is arranged at an inner cylindrical surface of the receiving portion.

In particular, the inner cylindrical surface limits radially the interior of the receiving portion.

Preferably, the inner cylindrical surface is arranged axially from the bottom or the receiving portion to the opening for the shaft and circumferences the interior of the receiving portion.

Advantageously, the inlet is provided in an end region of the inner cylindrical surface and the end region is, in particular in the axial direction of the axis of the receiving portion, opposite to the opening and/or is close to the bottom of the receiving portion.

For example, an extension of the end region of the inner cylindrical surface is less than 50% of the entire axial extension of the inner cylindrical surface, preferably at less than 30% of the entire axial extension, for example less than 20% of the entire axial extension of the inner cylindrical surface.

In some advantageous embodiments, the inlet is provided at an end of the inner cylindrical surface which is, in particular in an axial direction of the axis of the receiving portion, opposite to the opening side of the hub.

In particularly advantageous embodiments, the inlet is arranged at an edge where the inner cylindrical surface of the receiving portion and the bottom surface of the interior of the receiving portion intersect.

Accordingly, for example several preferred design options are combined in that way.

In particular, a perpendicular direction to a radially directed surface is at least approximately radially orientated to a respective axis and a perpendicular direction to an axially directed surface at least approximately axially directed to a respective axis.

In particular, above and below described axial and radial directions, in particular in connection with arrangements at the moveable scroll body, are with respect to the axis of the receiving portion and/or with respect to the central axis of the moveable scroll body.

In some preferred embodiments, the bottom surface of the receiving portion is in a direction, which is in particular in an operational state of the compressor the direction of gravity and/or the axial direction of the central axis of the moveable scroll body, offset to an outer surface of the base plate of the moveable scroll body at its second side and the outer surface surrounding the hub.

In particular, an axial distance between the opening for the shaft and the bottom surface of the receiving portion is larger than an axial distance between the opening and the outer surface, the axial distance being measured in the axial direction of the central axis of the moveable scroll body.

In particular, in at least some such embodiments the bottom of the receiving portion is closer to the opposing first side than the outer surface.

Preferably, the inlet is located within an axial offset section which extends in the axial direction with respect to the central axis of the moveable scroll body between the axial position of the bottom surface of the receiving portion and the axial position of the outer surface of the baseplate of the moveable scroll body at its second side and which in particular includes the axial position of the bottom face and of the axial position of the outer surface.

Advantageously, the inlet is provided with respect to the axial direction of the axis of the receiving portion and/or with respect to the axial direction of the central axis of the scroll body with an axial distance to the first side of the base plate of the moveable scroll body which is smaller than an axial distance between the outer surface of the base plate at the second side of the base plate of the moveable scroll body and the first side, in particular the axial distance is measured at the first side up to a surface of the base plate at the first side from which in particular the scroll rib projects.

For example, therewith the passage can be directed better to the outer surface, and provide it with lubricant.

In particular, the second side of the base plate to the moveable scroll body is in an operational state of the compressor downwardly directed with respect to the direction of gravity and therefore in such embodiments the inlet is provided higher than the outer surface at the second side and the lubricant can flow at least assisted by gravity towards the outer surface.

With respect to the position of the outlet of the passage no further details have been given so far.

In some preferred embodiments, the outlet is positioned in an axial direction closer to the opening side of the hub than the fluid inlet.

In particular, the axial direction is with respect to the axis of the receiving portion and/or with respect to the central axis of the scroll body.

In particular, the outlet is positioned in the axial direction further away from the bottom surface of the receiving portion than the fluid inlet.

In particular, the lubricant flow through the passage is enhanced for such an arrangement, for example forcing the lubricant out of the interior of the receiving portion and providing the lubricant to spots which are to be lubricated, in particular to a bearing at the outer surface of the moveable scroll body.

In particular, in some preferred embodiments the outlet is in the axial direction, in particular with respect to the axis of the receiving portion and/or with respect to the central axis of the scroll body, further away from the first side than the fluid inlet.

Preferably, the outlet is arranged at an outer cylindrical surface of the hub.

In particular, in such a solution the passage can be designed with a short extension and a solution which is simple to manufacture is provided.

In particular, the outer cylindrical surface of the hub extends at an outside of the hub and for example is arranged from the opening side of the hub at which the opening of the receiving portion is located to the outer surface at the base plate.

In particular, the outer cylindrical surface of the hub is a radially outward directed surface of the hub.

In particular the outlet is arranged closer to the base plate than to the opening side.

Advantageously, the outlet is arranged in an end region of the outer cylindrical surface, the end region is, in particular in the axial direction of the axis of the receiving portion, opposite to the opening side of the hub and/or is close to the base plate, in particular close to the outer surface.

Therewith, advantageously, a provision of lubricant through the passage to the second side of the base plate is improved.

For example, an extension of the end region of the outer cylindrical surface is less than 50% of the entire axial extension of the outer cylindrical surface, preferably less than 30% of the entire axial extension of the cylindrical surface, for example less than 20% of the entire axial extension of the outer cylindrical surface.

In some advantageous embodiments, the outlet is provided at an end of the outer cylindrical surface, the end being, in particular in the axial direction of the axis of the receiving portion, opposite to the opening side of the hub.

Preferably, the outlet arranged adjacent to the outer surface of the base plate of the moveable scroll body at the second side with the outer surface surrounding the hub.

For example, therewith lubricant provided through the passage is directly directed to the second side of the base plate and in particular to a bearing arranged there.

In particular advantageous embodiments, the outlet is arranged at an edge where the outer cylindrical surface of the hub and the outer surface of the base plate at the second side intersect.

For example, with this arrangement several advantageous design options are combined.

Preferably, the outlet is provided at least approximately at an axial position with respect to the central axis of the moveable scroll body at the outer surface of the base plate at the second side is located.

For example, therewith the lubricant is provided at least close to the outer surface and for example to a bearing there.

In particular, the outlet is provided at a radially inner region of the moveable scroll body.

For example, the radially inner region of the moveable scroll body is a region around the central axis of the moveable scroll body with the radially outer most part of the radially inner region having a distance from the central axis of less than 50% of a maximal radial extent of the scroll body, in particular of less than 50% of a maximal extent of the base plate.

For example, therewith the passage is provided to have a not too long extension and manufacturing the scroll body with the passage is simplified.

Advantageously, a shorter passage improves the flow of the lubricant therethrough.

In preferred embodiments, the outlet is provided close to a radially inner end region of the outer surface of the base plate at the second side.

In particular, the outer surface extends from a radially inner end, in particular at or close to the hub, radially outwards to a radially outer end, preferably as far as a radially outer end of the base plate.

Preferably, the outer surface surrounds the hub in a circumferential direction around the central axis of the scroll body.

In particular, positions of the outlet are close to the radially inner end region of the outer surface if they are radially inside the outer surface or are with respect to the radial direction closer to the radially inner end of the outer surface than to the radially outer end of the outer surface.

Preferably, the outlet is provided within a circle around a center axis of the moveable scroll body and with a radius which is the radial distance of the radially inner end of the outer surface from the central axis plus half of the radial extension of the outer surface from the inner radial end to the outer radial end.

Preferably the outlet is provided within a circle with a center on the central axis and with a radius which is the radial distance of the radially inner end of the outer surface plus one quarter of the radial extension of the outer strike.

In particular the outlet is provided within a circle around a center on the central axis and with a radius which is the radial distance of the radially inner end of the outer surface plus one tenth of the radial extension of the outer surface.

In some advantageous embodiments, the outlet is provided radially inside the outer surface of the base plate at the second side.

In preferred embodiments, a portion of the outer surface is designed as a sliding surface for a thrust bearing, the thrust bearing for example is built together with a support member.

The sliding surface has a complex shape, the shape being defined by the arrangement of the thrust bearing, in particular of the support member, and by the orbiting motion of the moveable scroll body.

In some embodiments a radially inner end of the sliding surface has a radial distance from the central axis of the moveable scroll body which depends on the circumferential position around the central axis at which the radial distance is measured and accordingly to radial distance varies between a smallest inner radial distance and a largest inner radial distance.

For embodiments in which the radial distance of the radially inner end of the sliding surface is constant along a circumferential direction around the central axis the smallest inner radial distance and the largest inner radial distance are the same.

In some embodiments the radial extension of the sliding surface in a radial direction of the central axis varies along the circumferential direction around the central axis between a smallest radial extension and a largest radial extension and the surface has an averaged radial extension which is the average of the radial extension of the sliding surface along the circumferential direction around the central axis. For embodiments in which the radial extension is constant in the circumferential direction around the central axis the largest radial extension, the smallest radial extension and the averaged radial extension of the sliding surface are the same.

Preferably, the outlet is provided within a circle around a center on the central axis of the moveable scroll body and it radius which is the smallest radial distance of the radially inner end of the sliding surface from the central axis plus half of the averaged radial extension of the sliding surface. Advantageously, the outlet is provided within a click around a center on the central axis and with a radius which is the smallest radial distance of the radially inner end of the sliding surface plus one quarter of the averaged radial extension of the sliding surface. In particular, the outlet is provided within a circle around a center on the central axis and with a radius which is the smallest radial distance of the radially inner end of the sliding surface plus one tenth of the averaged radial extension of the sliding surface.

In some advantageous embodiments the outlet is provided within the sliding surface, at least partly within the sliding surface.

In particular in such embodiments a radial distance of the outlet from the central axis of the moveable scroll body is larger than a radial distance of a radially innermost part of the sliding surface and is smaller than a radial distance of a radially outermost part of the sliding surface.

In some preferred embodiments the outlet is provided such that during the orbiting motion of the moveable scroll body the outlet is at least temporarily partly and/or fully covered by the thrust surface of the bearing portion of the support member.

Advantageously, therewith lubricant is directly provided at least temporarily to the sliding surface and the thrust surface which interact to form a thrust bearing.

In some preferred embodiments the position of the outlet has a radial distance to the central axis which is smaller than the largest radial distance of the radially inner end of the sliding surface from the central axis.

For example, the radial distance of the position of the outlet from the central axis is smaller than the smallest radial distance of the radially inner end of the sliding surface.

Preferably, the outlet is provided with respect to the radial direction of the central axis between the radially inner end of the outer surface and the radially inner end of the sliding surface.

Advantageously, therewith lubricant is provided to an inner radial end of the sliding surface at which the lubricant can flow between the sliding surface and the thrust surface which together form the thrust bearing for the moveable scroll body.

For example, with the outlet being provided close to the radial inner end of the sliding surface, the passage does not need to have a too long extension and the lubricant can in particular at least assisted by centrifugal forces flow to the sliding surface and in particular to the thrust bearing.

Further details about the configuration of the fluid passage, in particular between the inlet and the outlet, has not been given so far.

Preferably, the passage is arranged at least piecewise oblique to the axial direction and oblique to the radial direction, with the axial and radial direction being in particular with respect to the axis of the receiving portion and/or with respect to the central axis of the scroll body.

Advantageously, the passage is arranged along its entire extension from the inlet to the outlet oblique to the axial direction and the radial direction with the radial and axial direction being particular with respect to the axis of the receiving portion and/or with respect to the central axis of the scroll body.

For example, this provides for an easy to manufacture solution and which advantageously enhances the flow of lubricant.

In advantageous embodiments, the passage is arranged with increasing radial direction from the inlet towards the outlet in axial direction of the central axis closer to the opening side of the hub.

For example, the passage is arranged with increasing radial direction from the inlet towards the outlet further away from the first side of the base plate.

Preferably, the passage extends, for example along a direction of extension, from the inlet to the outlet at least piece wise straight.

In advantageous embodiments, it is provided that the passage extends, in particular along the direction of extension, from the inlet to the fluid outlet, that is in particular along its entire extension, straight.

For example, such a passage is more easy to manufacture.

In particular, a flow of lubricant through the straight passage is enhanced.

In preferred embodiments, the direction of extension of the passage is at least piecewise, preferably along the entire extension of the fluid passage, oblique to the axial direction and radial direction and in particular the axial and radial directions are with respect to the axis of the receiving portion and/or with respect to the central axis of the scroll body.

Advantageously, the direction of extension of the passage is directed along the entire extension of the passage from the inlet to the outlet at least approximately in the same direction.

In advantageous embodiments, the passage is arranged along the shortest way from the inlet to the hub environment surrounding the hub.

Preferably, the flow of lubricant through the short passage is enhanced.

In particular, this provides for a constructively easy solution.

Preferably, the outlet opens to the hub environment and is positioned such that it is closest to the inlet which opens the passage to the interior of the receiving portion.

In some embodiments the passage has an at least essentially constant diameter along its extension from the inlet to the outlet.

The diameter is measured in perpendicular direction with respect to the direction of extension from the inlet to the outlet.

In other preferred embodiments, the passage has a portion with a reduced diameter with respect to a diameter in another portion of the passage.

For example, passage has at least one portion at which its diameter is constant.

In preferred embodiments, the passage has at least one portion at which the diameter of the passage becomes smaller along the direction of extension of the passage towards the outlet.

For example, the passage has at least a first portion which extends from the inlet in direction towards the outlet and a second portion which is arranged closer to the outlet than the first portion.

For example, the second portion extends from or at least dose from the outlet in direction towards the inlet. In some embodiments, the passage has at least a third portion which is arranged between the first portion and the second portion of the passage.

In some preferred embodiments the diameter of the passage in the first portion is equal and/or larger than a first diameter and the diameter of the passage in the second portion is equal to and/or smaller than a second diameter which is smaller than the first diameter.

For example, in the third portion, the diameter of the passage changes from the first diameter to the second diameter.

In some preferred embodiments, the diameter of the passage changes continuously along the direction of extension from the first diameter in the first portion to the second diameter in the second portion of the passage.

In other preferred embodiments, the passage has in its interior at step at which the diameter of the passage changes from the first diameter to the second diameter.

In some embodiments, the diameter of the passage in the third portion is equal to or smaller than a third diameter and the third diameter is smaller than a constant or varying diameter in the first portion and/or smaller than a constant or varying diameter in the second portion.

Advantageously, with a reduced diameter in the passage lubricant is accelerated and for example sprays in an improved way towards the thrust bearing.

In particular, with a reduced diameter, the amount of lubricant which flows through the passage is limited for example to prevent to have too less oil to provide it to a bushing between the drive section and a hub.

The passage can be provided in different ways.

In preferred embodiments, at least one bore is provided in the moveable scroll body which at least partly forms the passage.

In some advantageous embodiments an insert is arranged in the at least one bore and a breakthrough in the insert forms at least a portion of the passage, for example the second portion, in particular a portion with a diameter which is smaller than a diameter of the portion formed by the at least one bore.

Further details the design of the hub and receiving portion have not been given so far.

For example, the hub comprises a hub wall which surrounds the interior of the receiving portion circumferentially.

In particular, the hub wall is part of the receiving portion.

Preferably, the hub wall projects in an axial direction from the second side of the base plate to the opening side of the hub.

In particular, at the opening side of the hub an axial end of the hub wall surrounds the opening of the receiving portion.

In particular, the hub wall has an inner cylindrical surface which limits the interior of the receiving portion, in particular in a radial direction of the axis of the receiving portion, and for example the inner cylindrical surface surrounds the interior circumferentially.

Preferably, the inner cylindrical surface extends axially from the bottom of the receiving portion to the opening of the receiving portion and in particular is arranged in a circumferential direction around the axis of the receiving portion.

In particular, the hub wall has an outer cylindrical surface which is in particular a surface of the hub wall which is, in particular in the radial direction of the axis of the receiving portion, opposite to the inner cylindrical surface of the hub wall.

Preferably, the outer cylindrical surface of the hub wall extends in axial direction from the second side of the base plate, in particular froth its outer surface, the axial end of the hub wall at the opening side of the hub.

In particular, the outer cylindrical surface is arranged in a circumferential direction around the axis of the receiving portion.

In preferred embodiments, the passage is at least partly, for example with its entirety, provided in the hub wall.

Advantageously, the inlet is provided at the inner cylindrical surface of the hub wall.

Preferably, the inlet is provided at the inner cylindrical surface closer to the bottom of the receiving portion than to the opening of the receiving portion.

In particularly advantageous embodiments, the inlet is provided in an end region, preferably at an end, of the inner cylindrical surface, the end region and the end being, in particular in the axial direction of the axis of the receiving portion, opposite to the opening side and/or being close to the bottom of the receiving portion.

For example, an extension of the end region of the inner cylindrical surface is less than 50% of the entire axial extension of the inner cylindrical surface, preferably less than 30% of the entire axial extension of the inner cylindrical surface, for example less than 20% of the entire axial extension of the inner cylindrical surface.

In particular, the arrangement of the inlet at the inner cylindrical surface of the hub wall is at least approximately similar to the arrangement of the inlet in preferred embodiments at the inner cylindrical surface of the receiving portion and therefore the respective explanations correspond in advantageous embodiments to each other.

In particular, the inner cylindrical surface of the receiving portion is built by the inner cylindrical surface of the hub wall.

Preferably, the inlet is arranged at an edge where the inner cylindrical surface and the bottom surface of the receiving portion intersect.

Advantageously, the outlet is provided at the outer cylindrical surface of the hub wall.

In particular, the outlet is provided at the outer cylindrical surface closer to the base plate than to the opening side.

In advantageous embodiments, the outlet is provided in an end region, preferably at an end, of the outer cylindrical surface with the end region and the end being, in particular in the axial direction of the axis of the receiving portion, opposite to the opening side and/or close to the base plate, in particular close to its outer surface.

For example, the extension of the end region of the outer cylindrical surface is less than 50% of the entire axial extension of the outer cylindrical surface of the hub wall, preferably less than 30% of the entire axial extension, for example less than 20% of the entire axial extension of the outer cylindrical surface of the hub wall.

In particular, the arrangement of the outlet at the outer cylindrical surface of the hub wall is at least similar to the arrangement of the outlet in preferred embodiments at the outer cylindrical surface of the hub and therefore the respective explanations correspond in particular to each other.

In particular, the outer cylindrical surface of the hub at least comprises the outer cylindrical surface of the hub wall.

Preferably, the outlet is arranged at an edge where the outer cylindrical surface of the hub wall and the outer surface of the base plate at the second side intersect.

Advantageously, the passage is arranged oblique and/or straight through the hub wall, in particular as described above and it is fully referred to the explanations given above thereto.

In advantageous embodiments, a receiving chamber for lubricant is formed in the interior of the receiving portion.

Preferably, the bottom surface of the interior limits the receiving chamber.

In particular, the receiving chamber is arranged at the bottom of the receiving portion.

Preferably, the receiving chamber is arranged axially between the bottom of the receiving portion and an axial end of the drive section engaging in the receiving portion.

For example, the receiving chamber is formed in between the bottom surface of the interior and an axial end surface of the drive section directed to the bottom surface.

Preferably, the inlet of the passage opens into the receiving chamber. In particular, therewith a flow of lubricant from the receiving chamber to the passage and further to the hub environment is promoted.

Advantageously, the inlet of the passage is provided between the axial end of surface of the drive section, which is directed to the bottom surface and located in the receiving portion, and the bottom surface of the receiving portion.

In particular, the drive section of the shaft is axially offset to an axis of the shaft.

In particular, the drive shaft is rotating about the axis of the shaft during operation of the compressor and drives with the offset drive section the moveable scroll body on an orbital path.

Preferably, the axis of the shaft coincides at least approximately with a central axis of the other, in particular stationary, scroll body of the two scroll bodies.

In particular, the axis of the receiving portion, the central axis of the moveable scroll body and an axis of the drive section at least approximately coincide.

Advantageously, between the drive section of the shaft and the inner cylindrical surface of the receiving portion a bushing is provided.

Preferably, the inlet of the passage is provided axially between the bushing and the bottom surface of the receiving portion.

In other preferred embodiments, the passage extends through the bushing and the bushing provides the inlet of the bushing.

For example, therewith lubricant provided to or close to the bottom of the receiving portion is enabled to flow both to the passage as well as to the bushing for lubrication.

In particular, the receiving chamber is at least partly located between the bottom surface of the receiving portion and the bushing.

Advantageously, at least in an operational state of the scroll compressor the outlet of the passage is provided below the inlet of the passage with respect to the direction of gravity.

For example, therewith the flow of lubricant through the passage is at least assisted by gravity.

In particular, the base plate of the moveable scroll body extends mostly along a geometrical base plane.

For example, an extension of the base plate within the geometrical base plane is much larger, preferably at least five times larger, in particular at least ten times larger, than an extension of the base plate perpendicular to the geometrical base plane.

In particular, the first side and the second side are on opposing sides of the geometrical base plane.

Further details about the other scroll body of the two scroll bodies have not been given so far.

In particular, the other scroll body, that is the stationary scroll body, is fixed to a housing of the scroll compressor.

For example, the other scroll body has a base plate from which its scroll rib projects.

In particular, the base plate of the other scroll body extends mostly in a respective geometrical plane.

Preferably, the scroll ribs of the two scroll bodies are designed and engage each other to form at least one compression chamber for compression of the gaseous medium, in particular a refrigerant.

Further details with respect to the scroll compressor have not been given so far.

Advantageously, the scroll compressor comprises a support member which provides at least with a bearing portion a thrust bearing that supports the moveable scroll body.

In particular, the support member, for example its bearing portion, has a thrust surface at which it contacts the moveable scroll body at a sliding surface which is part of the outer surface of the base plate at the second side.

Advantageously, the sliding surface is formed and arranged as described above in connection with preferred embodiments of a scroll body.

In particular the outlet of the passage is provided close to the thrust bearing, preferably close to a radially inner side of the thrust bearing.

In preferred embodiments, the outlet of the passage is provided in radial direction closer to the central axis of the moveable scroll body than the radially inner side of the thrust bearing.

In particular, the outlet is provided at least close to a radially inner end of the bearing portion.

Preferably, the outlet is provided in the radial direction with a distance to the axis of the shaft which is smaller than a radial distance of a radially innermost part of the bearing portion.

Advantageously, therewith the thrust bearing is provided with lubricant provided by the passage and for example the lubricant flows to the thrust bearing at least assisted by the centrifugal forces which occur due to the orbital movement of the receiving chamber build in the moveable scroll body and the lubricant received therein.

Advantageously, the outlet is arranged at least close to a radially inner end region of the sliding surface and/or outer surface, in particular as described above.

In particular, the thrust surface extends in the radial direction of the shaft axis from a radially innermost end to a radially outermost end and has a radial extension which is measured in the radial direction between the radially innermost end and the radially outermost end.

Preferably, a radial distance of the outlet from the shaft axis is smaller than a radial distance of the radially outermost end of the thrust surface from the shaft axis.

For example, the radial distance of the outlet from the shaft axis is smaller than a radial distance of the radially innermost end of the thrust surface from the shaft axis plus one half of the radial extension of the this surface.

Preferably, the outlet of the passage is provided in radial direction closer to an axis than a radially innermost part of the thrust surface of the support member, the axis being the central axis of the moveable scroll body and/or the shaft axis.

In particular, the outlet of the passage is provided in radial direction closer to the central axis of the moveable scroll body than a radially innermost part of the sliding surface or the moveable scroll body.

For example, therewith the lubricant provided by the passage is enabled to flow to the thrust surface and/or sliding surface to reduce wear at the thrust bearing, in particular at the surfaces of the moveable scroll body and support member.

In advantageous embodiments the outlet is provided with respect to the central axis of the moveable scroll body at an axial position which is at least approximately the same as the axial position of the thrust bearing.

In some advantageous embodiments, the surfaces of the thrust bearing, that is the sliding, surface and the thrust surface, and the outlet are preferably at least approximately at a same axial position along the axis of the moveable scroll body.

In particular, the support member, in particular its bearing portion, has a breakthrough in which the hub of the moveable scroll body is at least partially arranged.

In particular, the breakthrough extends through the support member, in particular through its bearing portion, and the thrust surface surrounds, in particular at a side which races towards the moveable scroll body, the breakthrough.

In particular, the shaft or at least the drive section of the shaft, extends from the other side, which faces away from the moveable scroll body, into the breakthrough and for example the drive section engages the hub in the breakthrough.

Advantageously, the outlet of the passage opens into the breakthrough.

In particular, in this way lubricant provided by the passage can reach the thrust bearing provided by the support member in an improved manner.

Preferably, the outlet of the passage opens at an axial end of the breakthrough which faces towards the moveable scroll body into the breakthrough.

For example in this way, the outlet is closer to the thrust bearing and lubrication of the same by lubricant provided by the passage is enhanced.

In particular, an opening of the breakthrough at its axial end facing towards the moveable scroll body is surrounded by the thrust surface.

In preferred embodiments, the support member has a slanted edge at the axial end of the breakthrough facing towards the moveable scroll body.

Above mentioned problem is in addition or in an alternative also solved according to the invention by a scroll compressor wherein the scroll compressor comprises two scroll bodies each of which have a scroll rib and the scroll ribs engage each other to form at least one compression chamber and the scroll compressor further comprises a drive shaft for driving a moveable scroll body of the two scroll bodies, wherein the moveable scroll body has at a first side its scroll rib and at a second side a hub for a drive section of the drive shaft and the drive section engages in a receiving portion of the hub, and wherein the scroll compressor further comprises a support member which provides a thrust bearing that supports the moveable scroll body and the support member has a breakthrough for the hub and/or drive shaft, and the support member has a slanted edge at its radially inner side of the axial end of the breakthrough, in particular at an opening of the breakthrough, facing towards the moveable scroll body.

Advantageously, the slanted edge enhances reception of lubricant, in particular for the thrust bearing, and for example wear is reduced.

Preferably the slanted edge surrounds the breakthrough circumferentially, in particular surrounds circumferentially the opening of the breakthrough facing towards the moveable scroll body.

In particular, the scroll compressor, for example its support member and/or its scroll bodies and/or other parts, has one or more of above or below explained preferred features.

Preferably above described preferred embodiments have in addition one or more features as described below.

In particular, a radially inward directed surface of the support member, in particular of its bearing portion, limits the breakthrough at least at an axial end region facing towards the moveable scroll body.

Advantageously, the thrust surface and the radially inward directed surface of the member are connected by a slanted transition surface.

Preferably the slanted edge is formed at least partly by the slanted transition surface.

In some preferred embodiments the slanted edge is a chamfer.

In some advantageous embodiments the slanted edge is a rounded edge.

In advantageous embodiments, a void space between the outer surface of the base plate and the support member is formed adjacent to the thrust bearing and the void space opens into the breakthrough.

In particular, the void space is formed at the slanted edge and/or the slanted transition surface.

Preferably, the void space gets narrower towards the thrust bearing.

In particular, with a slanted edge and/or the slanted transition surface and/or the void space lubricant provided to the breakthrough in particular from the passage is guided towards the thrust bearing.

Advantageously, the outlet of the passage faces towards the slanted edge and/or towards the slanted transition surface and/or towards the void space.

Further details to the scroll compressor have not been given so far.

In particular, the scroll compressor comprises a compressor housing, in which the two scroll bodies are arranged.

In particular, the compressor housing has an inlet port and an outlet port between which in the housing a fluid path for the gaseous medium, in particular a refrigerant, is defined.

More particularly, the fluid path passes through the engaging scroll ribs for compressing the gaseous medium.

Preferably, a lubricant sump is provided within the compressor housing, in particular at the bottom of the housing.

Advantageously, the drive shaft provides a lubricant passage way, which is in particular formed within the drive shaft.

Preferably, the lubricant passage way is inclined with respect to the axis of the shaft. In particular, therewith lubricant is pumped upwards from the lubricant sump in particular to the receiving chamber by the centrifugal forces which are present due to the rotation of the drive shaft.

In particular, the lubricant passage way of the drive shaft connects the lubricant sump with the interior if the receiving portion.

Preferably, the lubricant passage way opens into the receiving chamber in the interior of the receiving portion.

Advantageously, therewith lubricant is provided in a constructively easy way to the hub of the moveable scroll body and to the passage there.

Above and in the following, features which are described to be provided in particular, for example, advantageously, preferably and the like are optional features which are not essential for the invention but for example provide advantageous improvements.

Before and in the following values or directions or positions and the like which are provided "at least approximately" are to be understood that deviations therefrom which are technically conditioned and/or technically irrelevant are comprised by the at least approximately provided value, direction, position and the like. For example, deviations by at least approximately provided entities up to ±10%, preferably up to ±5%, in particular up to ±1% are comprised. For example, directions which deviate up to 20°, preferably up to 10°, in particular up to 5°, for example up to 1° are comprised by an at least approximately provided direction.

In particular, advantageous embodiments of the invention comprise the combination of features as defined by the following consecutively numbered embodiments.

1. Scroll compressor (110), the scroll compressor (110) comprises two scroll bodies (192, 194) each having a scroll rib (226, 228) and the scroll ribs (226, 228) engage each other to form at least one compression chamber (232), and the scroll compressor (110) further comprises a drive shaft (152) for driving a moveable scroll body (194) of the two scroll bodies (192, 194), wherein the moveable scroll body (194) comprises a base plate (214) which has two opposing sides, wherein on a first side (224) of the two opposing sides the scroll rib (228) is arranged and on a second side (258) of the two opposing sides a hub (256) is arranged, the hub (256) comprising a receiving portion (264) for a drive section (262) of the drive shaft (152), and wherein the moveable scroll body (194) comprises at least one passage (312) from an interior (268) of the receiving portion (264) to a hub environment (318) located around the hub (256) at the second side (258) of the two opposing sides.

2. Scroll compressor (110) according to embodiment 1, wherein the passage (312) has an inlet (314) connecting fluidly the interior (268) of the receiving portion (264) with the passage (312) and/or has an outlet (316) connecting fluidly the passage (312) with the hub environment (318).

3. Scroll compressor (110) according to one of the preceding embodiments, wherein the inlet (314) of the passage (312) is provided in an end region of the (268) of the receiving portion (264) opposite, in particular opposite in an axial direction of an axis of the receiving portion (264), to an opening (272) of the receiving portion (264) for the drive section (262).

4. Scroll compressor (110) according to one of the preceding embodiments, wherein the inlet (314) of the passage (312) is arranged adjacent to a bottom surface (275) of the interior (268) of the receiving portion (264) with the interior (268) extending from the opening (272) of the receiving portion (264) for the drive section (262) to the bottom face (275).

5. Scroll compressor (110) according to one of the preceding embodiments, wherein the passage (312) exits the interior (268) of the receiving portion (264) inclined to a radial direction or radially at the inlet (314), in particular inclined to a radial direction with respect to an axis of the receiving portion (264) and or with respect to a central axis (244) of the moveable body (194) or in particular radially with respect to an axis of the receiving portion (264) and/or with respect to a central axis (244) of the movable scroll body (194).

6. Scroll compressor (110) according to one of the preceding embodiments, wherein the inlet (314) of the passage (312) is arranged at an inner cylindrical surface (328) of the receiving portion (264).

7. Scroll compressor (110) according to one of the preceding embodiments, wherein the inlet (314) of the passage (312) is arranged at an edge where the inner cylindrical surface (328) of the receiving portion (264) and the bottom surface (275) of the interior (298) of receiving portion (264) intersect.

8. Scroll compressor (110) according to one of the preceding embodiments, wherein the bottom surface (275) of the receiving portion (264) is in axial direction offset to an outer surface (336) of the base plate (214) of the moveable scroll body (194) at its second side (258) and the outer surface (336) surrounds the hub (256) and in particular the inlet (314) of the passage (312) is located within an axial offset section which extend from the axial position of the bottom surface (275) of the receiving portion (264) to the axial position of the outer surface (336), the axial direction being in particular with respect to the axis of the receiving portion (294) and/or with respect to the central axis (244) of the moveable scroll body (194).

9. Scroll compressor (110) according to one of the preceding embodiments, wherein the inlet (314) is provided with respect to the axial direction, in particular with respect to the central axis (244) of the moveable scroll body (194), with an axial distance to the first side (224) of the base plate (214) of the moveable scroll body (194) which is smaller than an axial distance between the outer surface (336) of the base plate (214) at the second side (258) and the first side (224) surrounding the hub (256).

10. Scroll compressor (110) according to one of the preceding embodiments, wherein the outlet (316) of the passage (312) is positioned in an axial direction, in particular with respect to the axis of the receiving portion (264), closer to an opening side of the hub (256) in which the opening (272) of the receiving portion (264) is arranged than the inlet (314) of the passage (312).

11. Scroll compressor (110) according to one of the preceding embodiments, wherein the outlet (316) of the passage (312) is arranged at an outer cylindrical surface (332) of the hub (256).

12. Scroll compressor (110) according to one of the preceding embodiments, wherein the outlet (316) of the passage (312) is arranged in an end region (337) of the outer cylindrical surface (332) of the hub (256), the end region (337) being, in particular in the axial direction of the axis of the receiving portion (264), opposite to the opening side of the hub (256).

13. Scroll compressor (110) according to one of the preceding embodiments, wherein the outlet (316) of the passage (312) is arranged adjacent to an outer surface (336) of the base plate (214) of the moveable scroll body (194) at its second side (258) with the outer surface (336) surrounding the hub (256).

14. Scroll compressor (110) according to one of the preceding embodiments, wherein the outlet (316) of the passage (312) is provided at an edge (338) where the outer cylindrical surface (332) of the hub (256) and the outer surface (336) of the base plate (214) of the moveable scroll body (194) at its second side (258) intersect with the outer surface (336) surrounding the hub (256).

15. Scroll compressor (110) according to one of the preceding embodiments, wherein the outlet (316) of the passage (312) is provided at least approximately at an axial position with respect to the central axis (244) of the moveable scrod body (194) at which the outer surface of the base plate (214) at the second side (256) is located.

16. Scroll compressor (110) according to one of the preceding embodiments, wherein the outlet (316) of the passage (312) is provided close to a radially inner end region of the outer surface (336) of the base plate (214) at the second side (258), wherein in particular the outlet (316) of the passage (312) is provided within a circle around a center on the central axis (244) of the moveable scroll body (194) and with a radius which is the radial distance of a radially inner end of the outer surface (336) from the central axis (244) plus half of the radial extension of the outer surface (336), in particular the radius is the radial distance of the radially inner end of the outer surface (336) plus one quarter of the radial extension of the outer surface (336), in particular the radius is the radial distance of the radially inner end of the outer surface (336) plus one tenth of the radial extension of the outer surface (336).

17. Scroll compressor (110) according to one of the preceding embodiments, wherein a part of the outer surface (336) of the base plate (214) at the second side (258) is designed as sliding surface (354) for a thrust bearing.

18. Scroll compressor (110) according to one of the preceding embodiments, wherein the outlet (316) of the passage (312) is provided close to a radially inner end region of the sliding surface (354) at the second side (258) of the base plate (214).

19. Scroll compressor (110) according to one of the preceding embodiments, wherein the position of the outlet (316) has a radial distance from the central axis of the moveable scroll body (194) with the radial distance of the outlet (316) being smaller than the largest radial distance of the radially inner end of the sliding surface (354) in particular smaller than the smallest radial distance of the radially inner end of the sliding surface (354).

20. Scroll compressor (110) according to one of the preceding embodiments, wherein the passage (312) is arranged at least piecewise, in particular along its entire extension from the inlet (314) to the outlet (316), oblique to the radial direction and axial direction and the radial and axial direction being with respect to the axis of the receiving portion (264) and/or with respect to the central axis (244) of the scroll body (194).

21. Scroll compressor (110) according to one of the preceding embodiment, wherein the passage (312) is arranged with increasing radial distance from the inlet (314) towards the outlet (316) in axial direction closer to the opening side of the hub (256).

22. Scroll compressor (110) according to one of the preceding embodiments, wherein the passage (312) extends, in particular along a direction of extension (322), from the inlet (314) to the outlet (316) straight.

23. Scroll compressor (110) according to one of the preceding embodiments, wherein a direction (322) of extension of the passage (312) from the inlet (314) to the outlet (316) is oblique to the axial direction and radial direction, the axial and radial direction being with respect to the axis of the receiving portion (264) and/or with respect to the central axis (244) of the scroll body (194).

24. Scroll compressor (110) according to one of the preceding embodiments, wherein the direction (322) of extension of the passage (312) is directed along the entire extension of the passage (312) at least approximately in the same direction.

25. Scroll compressor (110) according to one of the preceding embodiments, wherein the passage (312) is arranged along the shortest way from the inlet (314) to the hub environment (318) surrounding the hub (256).

26. Scroll compressor (110) according to one of the preceding embodiments, wherein the hub (256) comprises a hub wall (266) and the hub wall (266) surrounds the interior (268) of the receiving portion (264) circumferentially and projects in an axial direction from the second side (258) of the base plate (214) to the opening side of the hub (256) and the opening (272) of the receiving portion (264) at the opening of the hub (256) is surrounded by an axial end of the hub wall (266).

27. Scroll compressor (110) according to one of the preceding embodiments, wherein the passage (312) is provided at least partly in the hub wall (266) of the hub (256).

28. Scroll compressor (110) according to one of the preceding embodiments, wherein the hub wall (266) of the hub (256) has an inner cylindrical surface (328) limiting the interior (268) Of the receiving portion (264) in a radial direction of the axis of the receiving portion (264) and in particular the inlet (314) of the passage (312) is provided at the inner cylindrical surface (328) of the hub wall (226).

29. Scroll compressor (110) according to one of the preceding embodiments, wherein the hub wall (266) has an outer cylindrical surface (332), which is in particular in a radial direction of the axis of the receiving portion (264) opposite to the inner cylindrical surface (328), and in particular the outlet (316) of the passage (312) is provided at the outer cylindrical surface (332) of the hub wall (226).

30. Scroll compressor (110) according to one of the preceding embodiments, wherein in the interior (268) of the receiving portion (264) a receiving chamber (282) for a lubricant is formed, wherein in particular the bottom surface (275) of the interior (268) limits the receiving chamber (282) and in particular the receiving chamber (282) is formed in between the bottom surface (275) of the interior (268) and an axial end surface of the drive section (262) directed to the bottom surface (275).

31. Scroll compressor (110) according to one of the preceding embodiments, wherein the inlet (314) of the passage (312) opens into the receiving chamber (282) in the interior (268) of the receiving portion (264).

32. Scroll compressor (110) according to one of the preceding embodiments, wherein the inlet (314) of the passage (312) is provided between the axial end surface of the drive section (262), which is directed to the bottom surface (275) and is located in the receiving portion (264), and the bottom surface (275) of the receiving portion (264).

33. Scroll compressor (110) according to one of the preceding embodiments, wherein between the drive section (262) of the shaft (152) and an inner cylindrical surface (328) of the receiving portion (264) a bushing (277) is provided.

34. Scroll compressor (110) according to one of the preceding embodiments, wherein the inlet (314) of the passage (312) is provided axially between the bushing (277) in the receiving portion (264) and the bottom surface (275) of the receiving portion (264).

35. Scroll compressor (110) according to one of the preceding embodiments, wherein at least in an operational state of the scroll compressor (110) the outlet (316) of the passage (312) is provided below the inlet (314) of the passage (312) with respect to the direction (162) of gravity.

36. Scroll compressor (110) according to one of the preceding embodiments, wherein the scroll compressor (110) comprises a support member (196) which provides a thrust bearing (198) that supports the moveable scroll body (194).

37. Scroll compressor (110) according to one of the preceding embodiments, wherein the support member (196) has a thrust surface (352) at which it contacts the moveable scroll body (194) at a sliding surface (354), the sliding surface (354) being a part of an outer surface (336) of the base plate (214) of the moveable scroll body (194) at the second side (258).

38. Scroll compressor (110) according to one of the preceding embodiments, wherein the outlet (316) of the passage (312) is provided in radial direction closer to the central axis (244) of the moveable scroll body (194) than a radially inner side of the thrust bearing (198).

39. Scroll compressor (110) according to one of the preceding embodiments, wherein the outlet (316) of the passage (312) is provided in radial direction closer to the central axis (244) of the moveable scroll body (194) than a radially innermost part of the thrust surface (352) of the support member (196).

40. Scroll compressor (110) according to one of the preceding embodiments, wherein the outlet (316) of the passage (312) is provided with respect to the central axis (244) of the moveable scroll body (194) at an axial position which is at least approximately the same as the axial position of the thrust bearing (198).

41. Scroll compressor (110) according to one of the preceding embodiments, wherein the support member (196) has a breakthrough (362) in which the hub (256) of the moveable scroll body (194) is at least partially arranged.

42. Scroll compressor (110) according to one of the preceding embodiments, wherein the outlet (316) of the passage (312) opens into the breakthrough (362) of the support member (196).

43. Scroll compressor (110) according to one of the preceding embodiments, wherein the outlet (316) of the passage (312) opens into the breakthrough (362) of the support member (190) at an axial end of the breakthrough (362) winch faces towards the moveable scroll body (194).

44. Scroll compressor (110), in particular according to one of the preceding embodiments, the scroll compressor (110) comprises two scroll bodies (192, 194) each having a scroll rib (226, 228) and the scroll ribs (226, 228) engage each other to form at least one compression chamber (232), and the scroll compressor (110) further comprises a drive shaft (152) for driving a moveable scroll body (194) of the two scroll bodies (192, 194), wherein the moveable scroll body (194) has a hub (256) for a drive section (262) of the drive shaft (152), the drive section (262) engages in a receiving portion (264) of the hub (256), the scroll compressor (110) further comprises a support member (196) which provides a thrust bearing (198) that supports the moveable scroll body (194) and the support member (196) has a breakthrough (362) for the hub (256) and/or for the drive shaft (152) and the support member (196) has a slanted edge at its radial inner side of at the axial end of the breakthrough (362) facing towards the moveable scroll body (194).

45. Scroll compressor (110) according to one of the preceding embodiments, wherein the thrust surface (352) of the support member (196) and a radially inward directed surface of the support member (196), which limits the breakthrough (362) at least at an axial end region fixing towards the moveable scroll body (194), are connected by a slanted transition surface (368).

46. Scroll compressor (110) according to one of the preceding embodiments, wherein adjacent to the thrust bearing (198) a void space (372) between the outer surface (336) of the base plate (214) of the moveable scroll body (194) at the side (258) with the hub (256) and the support member (196), in particular at the slanted edge and/or at the slanted transition surface (368), is formed which opens into the breakthrough (362).

47. Scroll compressor (110) according to one of the preceding embodiments, wherein the void space (372) between the outer surface (336) and the support member (196) gets narrower towards the thrust bearing (198).

48. Scroll compressor (110) according to one of the preceding embodiments, wherein the outlet (316) of the passage (312) faces towards the slanted edge and/or towards the slanted transition surface (368) and/or towards the void space (372).

49. Scroll compressor (110) according to one of the preceding embodiments, wherein the drive shaft (152) provides a lubricant passage way (178) connecting a lubricant sump (172) with the interior (268) of the receiving portion (264), wherein in particular the lubricant passage way (178) opens into the receiving chamber (282) in the interior (268), wherein in particular the lubricant passage way (178) is inclined with respect to an axis (154) of the drive shaft (152).

Further, preferred features and advantages of the invention are the subject of the detailed specification below and the representation in the drawing of exemplary embodiments.

DETAILED DESCRIPTION OF THE INVENTION

An embodiment of a compressor assembly with at least one scroll compressor 110 is exemplarily shown in the FIGS. 1 to 6.

Figure 1:
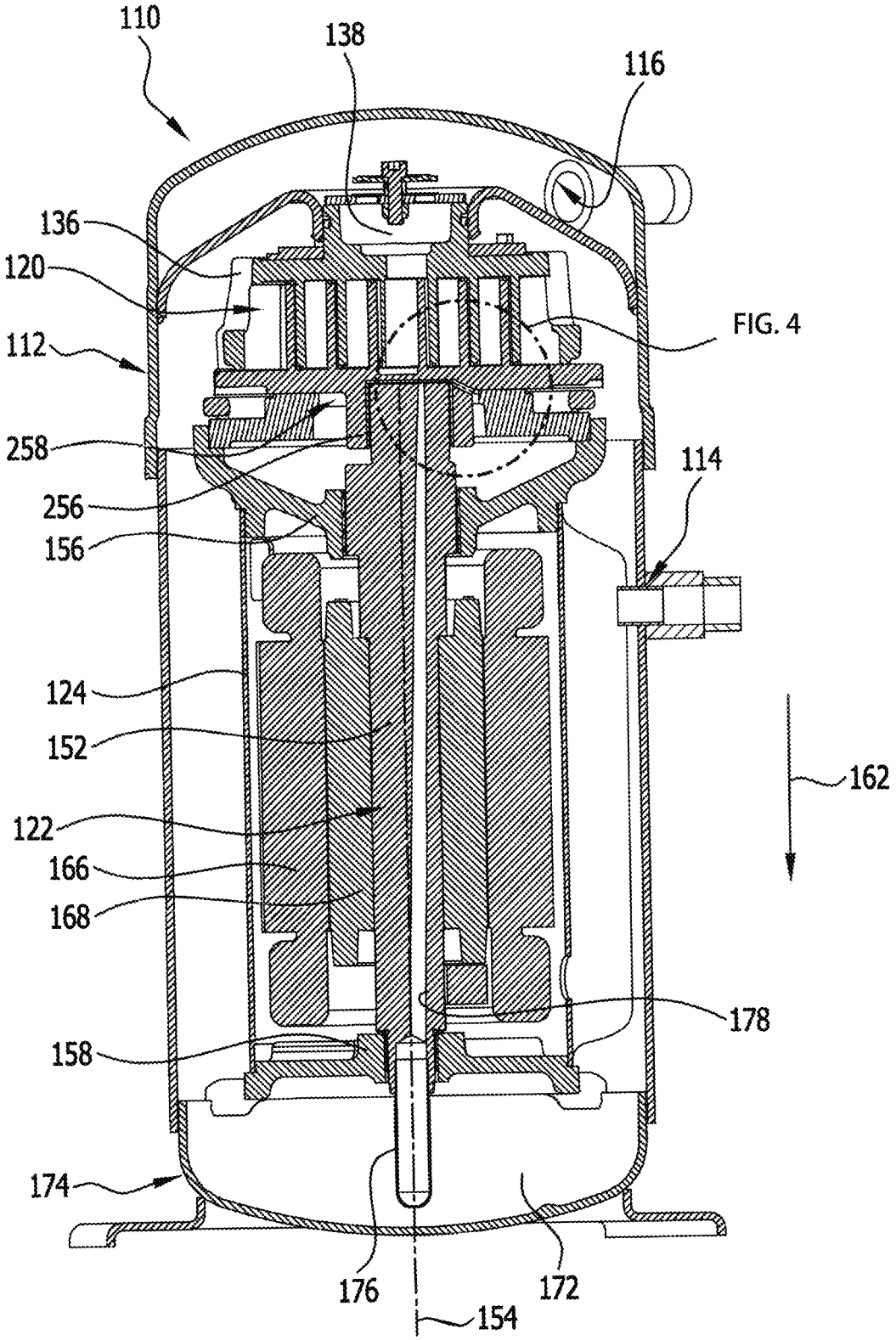
FIG. 1 shows a cross section through an embodiment of a scroll compressor.

The scroll compressor 110 comprises a compressor housing 112 with an inlet port 114 and an outlet port 116 for a gaseous medium and in the interior of the compressor housing 112 a fluid path for the gaseous medium from the inlet port 114 to the outlet port 116 is defined, as exemplarily shown in FIG. 1.

In particular, the gaseous medium is a refrigerant and for example the gaseous medium is a working fluid of a cooling circuit and/or a working fluid of a circuit of a heat pump.

Within the fluid path a compression unit which is designated as a whole with 120 is provided for compressing the refrigerant from a low pressure state as provided to the inlet port 114 to a high pressure state provided to the outlet port 116 and the compression unit 120 is driven by a drive unit 122 of the compressor 110.

For example, the drive unit 122 is provided in a drive casing 124 within the compressor housing 112.

The gaseous medium is provided along the fluid path from the inlet port 114, in particular through the drive casing 124 to an intake area 136 at the compression unit 120, in which the gaseous medium is compressed and which supplies the compressed medium in the high pressure state to an discharge chamber 138 which is connected to the outlet port 116.

The drive unit 122 comprises a shaft 152 for driving the compression unit 120. The shaft 152 is rotatably mounted for rotation around a shaft axis 154 for example in an upper bearing support 156 and a lower bearing support 158 which are fixed in the compressor housing 112.

In particular, the lower bearing support 158 is positioned with respect to a direction 162 of gravity below the upper bearing support 156 in an operational state of the compressor 110.

In particular, the upper bearing support 156 is arranged between the compression unit 120 and the drive unit 122 at an end of the drive casing 124 facing towards the compression unit 120.

Preferably, the lower bearing support 158 is provided between the drive unit 122 and a bottom 174 of the compressor housing 112 at another end of the drive casing 124 which is opposite to the end with the upper bearing support 156.

Preferably, the drive unit 122 comprises a stator 166 for example with electrical coils and which is fixed to the drive casing 124 and a rotor 168 within the stator 166 and which is fixed, for example press fitted, glued, keyed or shrinked, to the shaft 152.

During operation the stator 166 and the rotor 168 operably work together to rotate the rotor 168 and together with the rotor 168 the shaft 152 around the shaft axis 154.

Furthermore, a lubricant sump 172 is provided in the compressor housing 112 in particular at a bottom 174 of housing 112 with the bottom 174 being at a lower end of the housing 112 with respect to the direction 162 of gravitation in an operational state of the compressor 110.

The shaft 152 extends into the lubricant sump 172 with an input section 176.

The input section 176 is in some variants an axial end section of shaft 152 and in other variants an impeller tube is attached to an axial end of the shaft 152.

Within the shaft 152 lubricant passage way 178 formed which connects the input section 176 with an output opening 182 at the other axial end of the shaft 152 opposite to the input section 176.

In particular, the lubricant passage way 178 is inclined with respect to the shaft axis 154.

Figure 2:
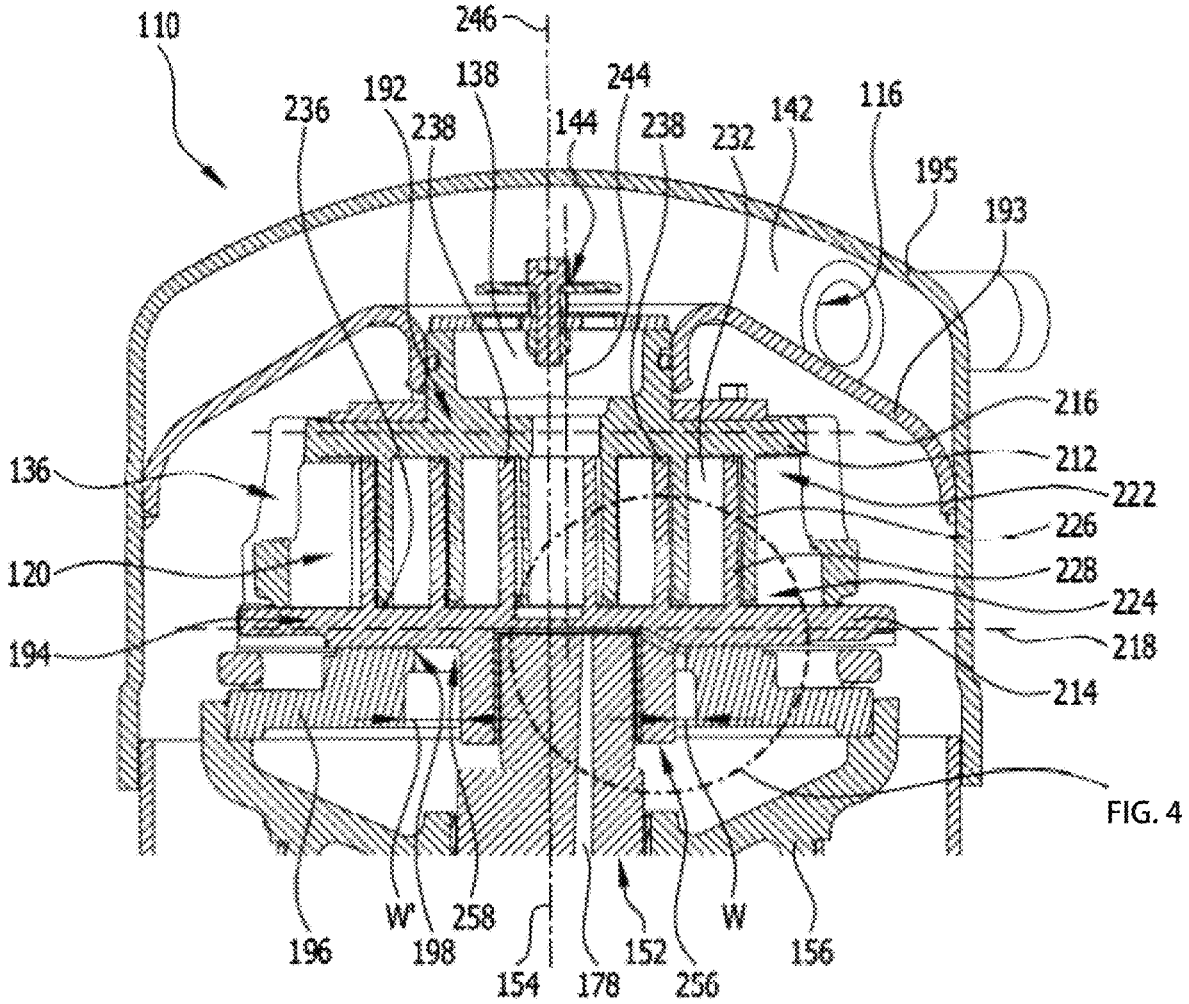
FIG. 2 shows a partially enlarged view of the scroll compressor shown in FIG. 1 in an area with a compression unit and an engaging drive shaft.

The compression unit 120 comprises two compression bodies which are designed as scroll bodies 192, 194, as exemplarily shown in particular in FIG. 2, one of which, here the scroll body 192 is fixed relative to the compressor housing 112 and the other scroll body, here scroll body 194, is moveable relative to the stationary scroll body 192 and accordingly moveable relative to the compressor housing 112.

The two scroll bodies engage each other and work operably together for compressing the gaseous medium, in particular the refrigerant.

For movably mounting of the moveable scroll body 194, a support member 106 is provided for supporting the moveable scroll body 194. The support member 196 provides in particular a thrust bearing 198 for the moveable scroll body 194.

The support member 196 is fixed within the compressor housing 112 and in particular mounted to the upper bearing support 156.

The stationary scroll body 192 is in particular fixed to the compressor housing 112 with a holding member 193.

Each of the scroll bodies 192, 194 have a respective base plate 212, 214 which extend mostly in respective geometrical base planes 216, 218, which are arranged at least approximately parallel to each other and at least approximately perpendicular to shaft axis 154.

In particular, the base plates 212, 214 have an extension within the respective base plane 216, 218 which are much larger, for example at least five times larger, preferably at least ten limes larger, as an extension of the respective base plate 212, 214 perpendicular to the respective base plane 216, 218.

On a side 222 of the stationary scroll body 192 a scroll rib 226 is arranged which projects at least approximately perpendicular away from the base plate 212 of the stationary scroll body 192 and the scroll rib 226 is designed in the form of a spiral.

On a first side 224 of the moveable scroll body 194 a scroll rib 228 is arranged which projects at least approximately perpendicular away from the base plate 214 of the moveable scroll body 194 and the scroll rib 228 is designed in the form of a spiral.

Figure 3:
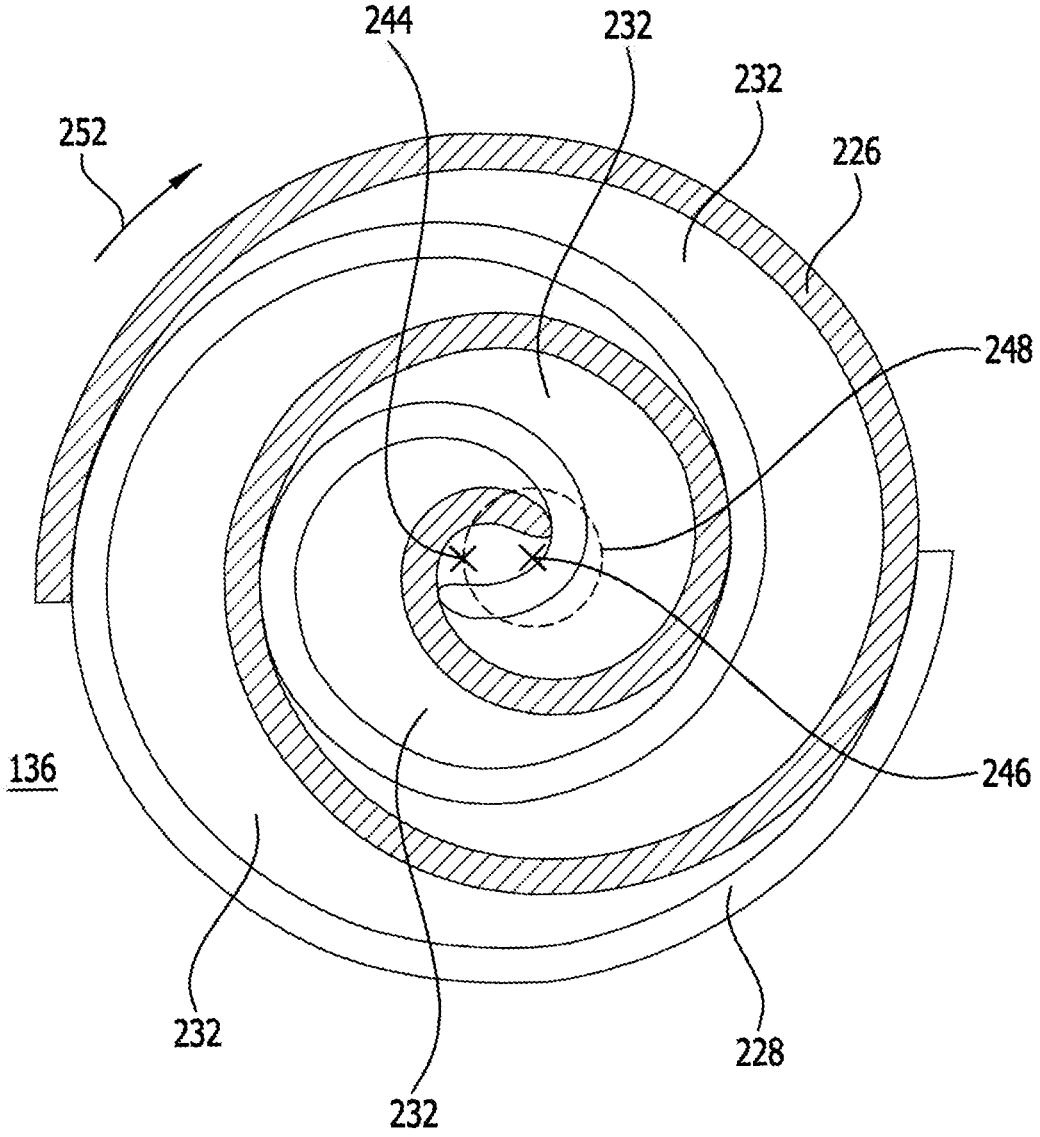
FIG. 3 shows a schematic view of engaging scroll ribs in the compression unit.
Figure 4:
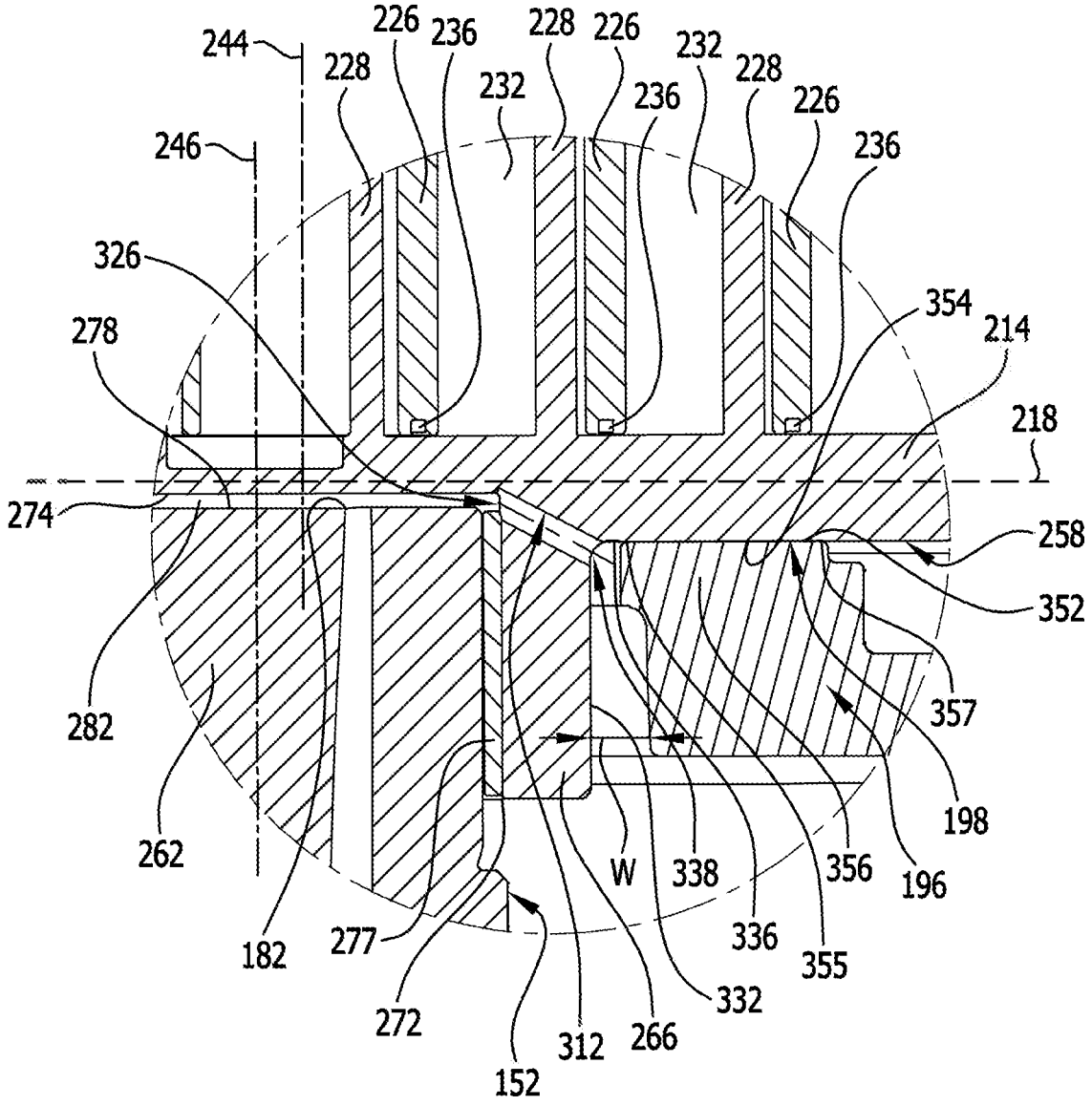
FIG. 4 shows an enlarged view of the area designated as FIG. 4 in FIGS. 1 and 2 showing partially a hub of a scroll body arranged in a breakthrough of a support member and a passage in the hub.

Both scroll bodies 192, 194 are arranged such that their scroll sides 222 and 224 face each other and the scroll ribs 226 and 228 engage in one another and form at least one compression chamber 232, preferably several compression chambers 232, between the scroll ribs 226, 228 and the base plates 212, 214 as exemplarily shown in FIGS. 2, 3, and 4.

Advantageously, the scroll ribs 226, 228 have at their axial end facing away from the respective base plate 212, 214 sealing elements 236 and 238, respectively, which abut sealingly against the base plate 214, 212 of the other scroll body 194, 192, for sealingly closing the at least one compression chamber 232 or the several compression chambers 232.

The scroll bodies 192, 194 are arranged to each other, such that the moveable scroll body 194 is mounted moveable with its central axis 244 around a central axis 246 of the stationary scroll body 192 on an orbital path 248.

Upon orbiting rotation of the moveable scroll body 194 in a rotation direction 252 a compression chamber 232 undergoes a compression circuit.

At the beginning of the compression circuit the compression chamber 232 is open at a radially outer periphery of the scroll body 194 in fluid contact with the intake area 136 such that the gaseous medium in the low pressure state enters in the compression chamber 232 and upon progressive orbiting rotation the compression chamber 232 moves along the spiral form of the scroll ribs 226, 228 and radially inward and thereby its volume decreases and the contained gaseous medium gets compressed and ultimately at a radially inner region the compression chamber is fluidly connected to the discharge chamber 138 to which the compressed gaseous medium in its high pressure state is discharged.

Figure 5:
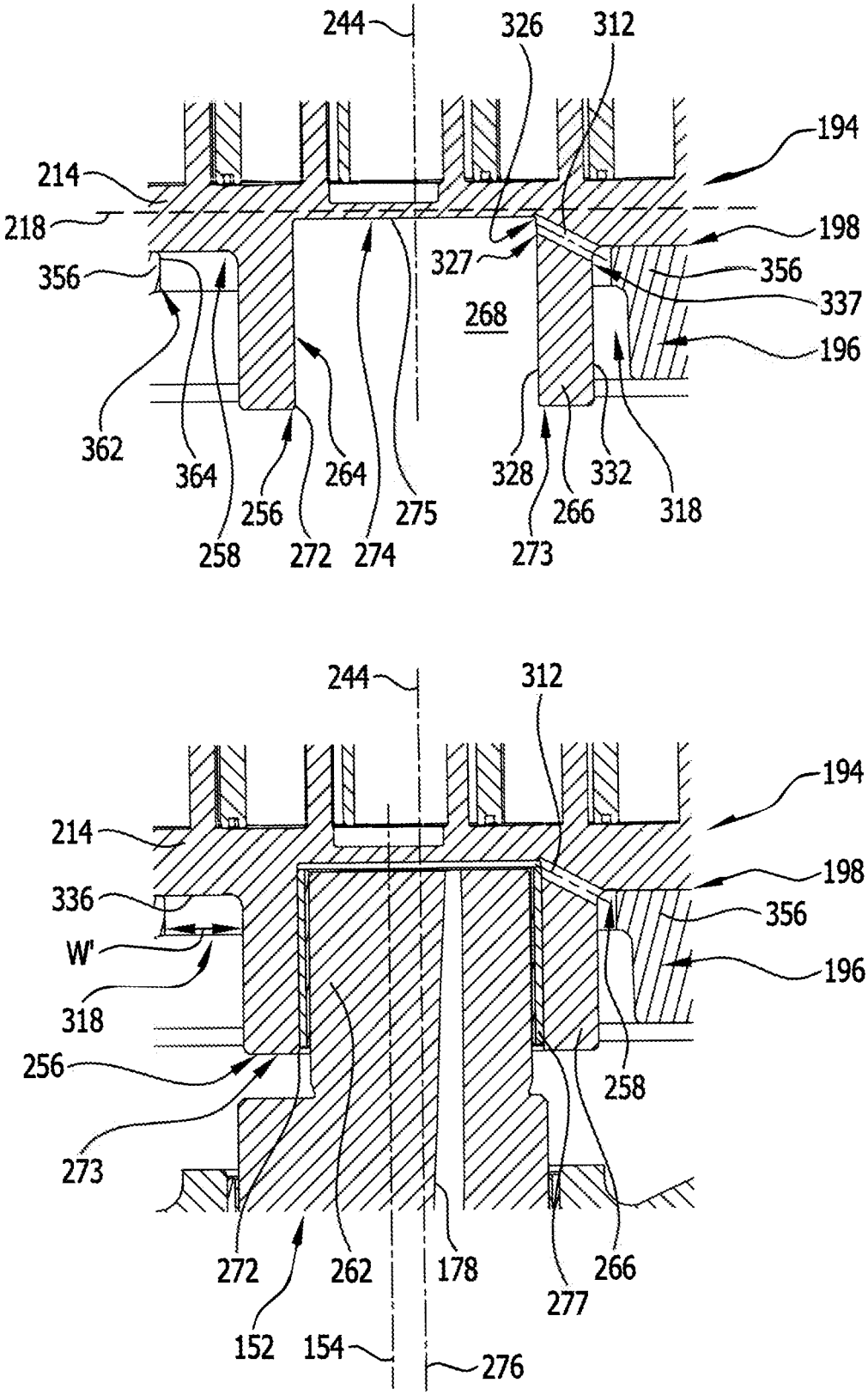
FIG. 5 shows an enlarged view of the hub of the scroll body with and without a drive section engaging in a receiving portion of the hub.

For the orbiting movement of the moveable scroll body 194, the moveable scroll body 194 has a hub 256 at a second side 258 which is, in particular in the axial direction of the central axis 244 of the scroll body 194, opposite to its first side 224, and the drive shaft 152 engages in the hub 256 with an eccentric offset drive section 262 which is provided at an axial end of the drive shaft 152 facing towards the moveable scroll body 194, as exemplarily shown in FIG. 5.

The hub 256 comprises a receiving portion 264 which is concentric with the central axis 244 of the moveable scroll body 194. The receiving portion 264 is in particular formed by a hub wall 266 which projects in axial direction with respect to the central axis 244 of moveable scroll body 194 away from the second side 258 and is arranged circumferential around the central axis 244 such that the hub wall 266 is preferably cylindrical and encloses radially an interior 268 of the receiving portion 264.

The interior 268 of the receiving portion 264 extends from a bottom 274 with a bottom surface 275 of the receiving portion 264 in an axial direction in particular with respect to the central axis 244 and preferably concentric therewith to an opening 272 of the receiving portion 264 at an opening side 273 of the hub which is, in particular in axial direction of the axis of the receiving portion 264, opposite to the side of hub 256 at which hub 256 is arranged to the base plate 214.

In particular, the opening 272 is surrounded by the hub wall 266 at its distant end to the base plate 214.

The eccentric offset drive section 262 is for example an axial eccentric extension of the drive shaft 152 with a smaller diameter than the main part of the drive shaft 152 and being at least approximately cylindrical around an offset axis 276.

The offset axis 276 is off the axis 154 of shaft 152 and in a mounted state the offset axis 276 at least approximately concentric with the central axis 244 of the moveable scroll body 194 and the axis of the receiving portion 264.

In variants of the embodiment the eccentric offset drive section 262 is a bearing pin offset to the shaft axis 154 and in the mounted state at least approximately concentric with the central axis 244 of the moveable scroll body 194.

The eccentric offset drive section 262 is rotatably engaged in the receiving portion 264 and therefore upon rotation of the drive shaft 152 around its shaft axis 154 the axis 276 of the drive section 262 performs an orbital movement around the shaft axis 154 and drives the moveable scroll body 194 along its orbital movement with the central axis 244 of the moveable scroll body 194 orbiting along the orbital path 248.

In particular, the moveable scroll body 194 is coupled to a coupling which prevents a rotary motion of the moveable scroll body 194 around its central axis 244 and/or around the axis 276 of the drive section 262.

Preferably, the coupling restricts the motion of the moveable scroll body 194 to linear motions along to two axes which are perpendicular to each other and the two axes are perpendicular to the axis 276 of the drive section 262.

Therewith, the orbiting motion of the moveable scroll body 194 is as a superposition of the linear motions along the two axes possible, but a rotary motion around the axis 276 of the drive section 262 is prevented.

For example, the coupling is an Oldham coupling known in the prior art.

Advantageously, between the drive section 262 and the hub wall 266 a bushing 277 is arranged, in particular for rotational support.

In particular the bushing 277 extends between axial ends between the opening 272 and the bottom 274 of the receiving portion 264 and surrounds the drive section 262 circumferentially.

The bushing 277 is with a radial inner surface in contact with the drive section 262 and contacts with a radial outer surface an inner cylindrical surface 328 of the hub wall 266.

The axial end of the bushing 277 facing towards the bottom 274 is spaced from the bottom 274 preferably at least approximately with an axial distance with which the axial end 278 of the drive section 262 is spaced from the bottom 274 of the receiving portion 264.

In variants of the embodiment the axial end of the bushing 277 facing towards the bottom 274 is arranged at the bottom surface 275.

The lubricant passage way 178 extends through the drive section 262 until its very axial end 278 at which the output opening 182 is provided and opens in a receiving chamber 282 formed between the axial end 278 and the bottom surface 275 of the receiving portion 264, as exemplarily shown in particular in FIG. 4.

Figure 6:
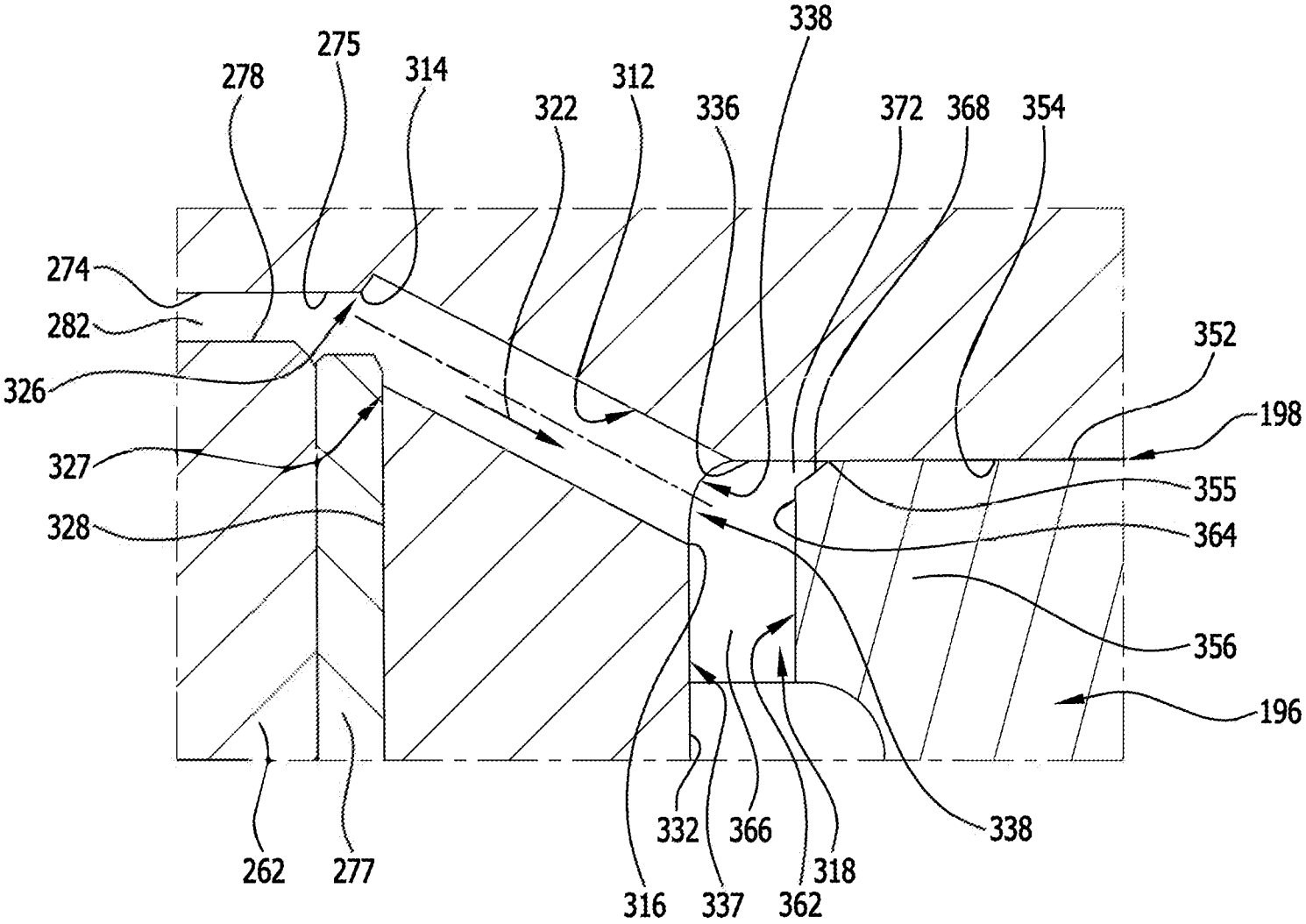
FIG. 6 shows an even more enlarged view in the area of the fluid passage.

Out of the receiving chamber 282 there is provided at least one passage 312, which extends from an inlet 314 at which the passage 312, in particular radially, opens into the receiving chamber 282 to an outlet 316 at which the passage 312 opens to a hub environment 318 which extends around the hub 256 and opposite to the of receiving portion 264 and is defined adjacent to the second side 258 of the base plate 214, as exemplarily shown in FIG. 6.

In some preferred embodiments there is exactly one passage 312.

In other advantageous embodiments there are several passages 312.

In particular, the passage 312 extends straight from the inlet 314 to the outlet 316 and extends along a constant direction 322 of extension, which is directed from the inlet 314 to the outlet 316 and is oblique to the base plane 218 and in particular oblique to the axial direction and radial direction of the central axis 244 of the moveable scroll body 134.

Advantageously, the passage 312 is arranged along the shortest way from the inlet 314 towards the hub environment 318 to which it opens at the outlet 316.

Preferably, the inlet 314 is provided in an end region 327, preferably at an end, of the inner cylindrical surface 328 of the receiving portion 264 with the end region 327 and the end facing towards the bottom 274 of the receiving portion 264 and being, in particular in axial direction the axis of the receiving portion 264, opposite to the opening side 273.

The hub wall 266 surrounds the interior 268 circumferentially around the axis of the receiving portion 264 and contains the inner cylindrical surface 328 which limits the interior 268 of the receiving portion.

In particular, the inner cylindrical surface 328 extends axially from the bottom surface 275 to the opening 272 of receiving portion 264.

Advantageously the inlet 314 is arranged at an inner edge 326 of the receiving portion 264 where the inner cylindrical surface 328 and the bottom surface 275 of the receiving portion 264 intersect.

In particular, the inlet 314 opens into the receiving chamber 282 and is arranged between the bottom surface 275 of the receiving portion 264 and the axial end of the bushing 277 which faces towards the bottom 274.

In the variant, in which the bushing 277 arranged with its axial end at the bottom surface 275, the passage 312 extends through the bushing 277 and the bushing 277 provides the inlet 314.

Preferably, the outlet 316 is provided at an outer cylindrical surface 332 of the hub 256.

The hub wall 266 contains the outer cylindrical surface 332 which faces radially outward towards the hub environment 318 and is arranged axially from the second side 258 of the base plate 214, in particular from the outer surface 336 of the base plate 214 at the second side 258, to the opening side 273 of hub 256 and is arranged circumferentially around the hub 256.

Advantageously, the outlet 316 is provided in an end region 337, in particular at an end, of the outer cylindrical surface 332 with the end region 337 and the end facing towards the base plate 214 and being, in particular in axial direction of the axis of the receiving portion 264, opposite to the opening side 273.

Preferably the outlet 316 is arranged at an outer edge 338 or the hub 256 where the outer surface 336 and the outer cylindrical surface 332 intersect.

In particular, the bottom surface 274 of receiving portion 264 is axially offset to the outer surface 336 of the base plate 214 at the second side 258 and therefore the passage 312, in particular from the inner edge 326 of the receiving portion 264, to the outer edge 338 at the hub environment 318 extends along the shortest way from the receiving chamber 382 to the hub environment 318.

For example, in the region of the outer surface 336 the base plate 214 is thicker than in the region of the receiving portion 264, with a thickness being measured in a direction which is perpendicular to the base plane 218.

In particular, the outer surface 336 extends essentially in a geometrical plane and the bottom surface 275 extends in another geometrical plane with both geometrical planes being. arranged at least approximately parallel to each other and perpendicular to the axis 244 of the moveable scroll body 194, The geometrical plane of the outer surface 336 is axially positioned between the bottom surface 275 and the opening 272.

The thrust bearing 198 is formed by a thrust surface 352 of a bearing portion 356 of the support member 196 and a sliding surface 354 of base plate 214 of the moveable scroll body 194. The sliding surface 254 is a portion of the outer surface 336 of the base plate 214 of the moveable scroll body 194 at its second side 258.

The moveable scroll body 194 is with its sliding surface 354 slidingly arranged on the thrust surface 352 of the bearing portion 356 of the support member 196.

The sliding surface 354 circumferentially surrounds the hub 256.

An inner radial end 355 of the sliding surface 354 is spaced from a radially inner end of the outer surface 336. In particular, the inner radial end 355 of the sliding surface 354 has a radial distance to the radially inner end of the outer surface 336 and in particular the radial distance varies along a circumferential direction of the axis of the receiving portion 264.

Accordingly, the outer surface 336 of the base plate 214 of the moveable scroll body has a ring portion which is radially arranged between the radially inner end of the outer surface 336 and the inner radial end 355 of the sliding surface 354.

The sliding surface 354 extends radially front the inner radial end 355 with a radial extension to outer radial end 357 of the sliding surface 354.

In particular, the outer radial end 357 has a smaller radial distance to the axis of the receiving portion 264 than a radially outer end of the outer surface 116.

For example, the radially outer end of the outer surface 336 is arranged at a radially outer end of the base plate 214.

The fluid outlet 316 is arranged close to the radially inner end of the outer surface 336 and close to the inner radial end 355 of the sliding surface 354. In particular, the fluid outlet 316 has a smaller radial distance to the axis of the receiving portion 264 than the radially inner end of the outer surface 336 and than the inner radial end 355 of the sliding surface 354.

Preferably, in the thrust surface 352 and/or in the sliding surface 354 small channels are formed which advantageously improve the flow of the lubricant between the two surface 352, 354. In particular, the channels are at least partly extending in radial direction with respect to the central axis of the moveable scroll body for providing the lubricant to different radial positions.

An axial position of the outlet 316 alone the central axis 244 of the moveable scroll body 212 is at least approximately the same as an axial position of the thrust bearing 198 and of the thrust surface 352 and sliding surface 354.

The support member 196 is arranged at least with the bearing portion 356 which provides the thrust surface 352 in the hub environment 318 and bearing portion 356 has a breakthrough 362 in which hub 256 is at least partially arranged.

The breakthrough 362 extends with respect to the shaft axis 54 and the central axis 244 of the moveable scroll body 194 axially through the bearing portion 356.

In particular, the hub 256 extends from one side into the breakthrough 362 and the shaft 152 extends at least with its drive section 262 from the other side into the breakthrough 362.

The bearing portion 356 faces axially with its thrust surface 352 towards the base plate 214 and has a radially inner surface 364 facing radially inwards to the breakthrough 362 and limiting the same.

The radially inner surface 364 faces towards the hub 256 and is opposite to the outer cylindrical surface 332 of the hub 256 with a gap 366 for clearance being provided between the radially inner surface 364 and the outer cylindrical surface 332.

The gap 366 allows the orbiting motion of the moveable scroll body 194 during which the hub 256 performs an orbiting motion within the breakthrough 362.

A width W, W' of the gap 366 varies along the circumferential direction around the hub 256 and around the axis 154 of the drive shaft 152 and the axis 244 of the movable scroll body 194 because the breakthrough 362 is essentially cylindrical with respect to the shaft axis 154 and the hub 256 is orbiting around the shaft axis 154 and is therefore offset to this axis. During the orbiting motion, a position at which the gap has a specific width W, W' moves circumferentially around the shaft axis 154 as the hub 256 orbits around the shaft axis 154 and at a specific circumferential position fixed relative to the bearing portion 356 the width W, W' of the gap 366 varies as the hub 256 orbits around the shaft axis 154.

Preferably, the bearing portion 356 has a slanted transition surface 368 which connects the thrust surface 352 with the radially inner surface 364 and with the transition surface 368 being arranged oblique to the base plane 218 of the base plate 214 of the moveable scroll body 194, as exemplarily shown in FIG. 6.

The slanted transition surface 368 is provided at an axial end of the bearing portion 356 facing towards the moveable scroll body 214 and surrounds the breakthrough 362.

The axial extension of the bearing portion 356 ends at the slanted transition surface 368, thereby creating a pocket with a void space 372 between the bearing portion 356 and the outer surface 336 of the base plate 214 of the moveable scroll body 194.

In particular, the bearing portion 356 has a slanted edge at its axial end facing towards the moveable scroll body 194 and which surrounds the breakthrough 362 circumferentially. Advantageously, at this slanted edge the slanted transition surface 368 is formed.

The void space 372 opens radially to the inside into the gap 366 between the hub 256 and the bearing portion 356 and extends radially outward to the contacting thrust and sliding surfaces 352, 354 of the thrust bearing 198.

In particular, the void space 372 becomes more narrow radially outwards towards the thrust bearing 198 as the slanted transition surface 368 is approaching with outwardly directed radial extension the outer surface 136 and merges into the thrust surface 352 for example at the radial position, at which the thrust surface 352 is in contact with the inner radial end 355 of the sliding surface 354.

In particular, briefly summarizing, the compressor 110 works as follows and has for example the following advantages.

Through the inlet port 114 a gaseous medium, in particular a refrigerant, is provided along the fluid path to the compression unit 120 in a low pressure state and the compression unit 120 being driven by the drive unit 122 compresses the gaseous medium and provides it in a high pressure state along the fluid path to the outlet port 116.

Preferably, the gaseous medium is guided along the fluid path through the drive casing 124 to flow through and around the drive unit 122, in particular the motor, and advantageously the gaseous medium cools thereby the drive unit 122.

For compressing the gaseous medium, the compression unit 120 has the moveable scroll body 194 which engages with the other scroll body 192 to form at least one compression chamber 232 the volume of which decreases upon orbiting movement of the moveable scroll body 194 and the gaseous medium in the compression chamber 232 is compressed.

The moveable table scroll body 194 has the hub 256 for connecting with the drive shaft 152 which drives the moveable scroll body 194 from compression and the shaft 152 engages with its drive section 262 in the receiving portion 264 of the hub 256.

For moveable arrangement of the moveable scroll body 194 the support member 196 axially and slidingly supports the moveable scroll body 194 and provides with the bearing portion 356 the thrust bearing 198 at which the bearing portion 356 contacts with the thrust surface 352 the sliding surface 354 of the base plate 214 of the moveable scroll body 194.

For lubrication of the thrust bearing 198 a lubricant is provided thereto along the lubricant passage way 178 through the shaft 152 into the receiving chamber 282 and from there through the passage 312 to the gap 366 and ultimately to the thrust bearing 198.

For feeding with lubricant, the shaft 152 extends with the input section 176 into the lubricant sump 172 such that the lubricant passage way 178 opens into the lubricant sump 172 and can receive lubricant from there and upon rotation of the shaft 152 lubricant is transferred through the passage way 178 up to the receiving chamber 282 in particular due to centrifugal forces and because the passage way 178 is inclined with respect to shaft axis 154.

The lubricant provided to the receiving chamber 282 flows partly, in some embodiments mainly, to the bushing 277 between the drive section 262 and the hub wall 266.

Another part of the provided lubricant in the receiving chamber 282 flows through the passage 312 and is provided to the gap 366 between the hub 256 and the bearing portion 356.

In particular, due to the arrangement of the outlet 316 close to the thrust bearing 198 which is formed at least partly by the sliding surface 354 and the thrust surface 352 the provision of the lubricant to the surfaces 354 and 352 of the thrust bearing is improved.

Advantageously, the flow of the lubricant through the downwardly directed passage 312 is at least assisted by gravity.

Due to the centrifugal force acting on the lubricant flowing through the passage 312 due to the orbital movement of the moveable scroll body 194 the lubricant at least partly reaches the bearing portion 356 the amount of which also depends on the respective gap width W at the outlet 316 which varies due to the orbital movement of scroll body 194.

In particular, the provision of the lubricant provided from the passage 312 towards the thrust bearing 198 is enhanced, because the lubricant as flowing downwardly with respect to gravity through the passage 312 and the outlet 316 is positioned axially and radially close to the thrust bearing 198 and in particular faces at least partly towards the void space 372.

Preferably, the provision of the thrust bearing 198 with lubricant is also enhanced by the slanted edge and/or the slanted transition surface 368 and the void space 372 formed there which opens more widely to the gap 366 and becomes narrower towards the thrust bearing 198. Thereby it is advantageous when the opening of the void space 372 into the gap 366 faces towards the outlet 316.

In particular, due to the slanted transition surface 368 and/or the chamfer a concentration of lubrication at a contact region between the sliding surface 354 and the thrust surface 352 is enhanced.

The lubricant reaching the thrust bearing 198 lubricates the bearing and provides improved movement of the moveable scroll body 194 relative to the support member 196 and reduces wear at the thrust bearing 198.

The other lubricant flows down through the compressor housing 112 in particular along a defined lubricant return path to the lubricant sump 172 and/or for example is provided to the upper bearing support 156 and/or the lower bearing support 158 and/or other parts of the compressor 110 for lubrication there.

In connection with another embodiment, which is exemplarily and partly shown in FIG. 7, elements and features which are at least essentially the same and/or fulfill at least the same basic function as an element of the above described embodiment are designated with the same reference sign and concerning their description it is fully referred to the specification given above unless in the following an alternative arrangement and/or design of these elements and/or features is provided. In particular, if an alternative arrangement and/or design is to be emphasized, a suffix "a" designating this embodiment will be attached to the respective reference sign.

The scroll compressor 110 of this embodiment has a stationary body 192 and moveable scroll body 194 with a hub 256 and both scroll bodies 192, 194 have scroll ribs which engage each other to or at least one compression chamber for compression of a gaseous medium.

The compressor comprises a support member 196 which at least with a bearing portion 356 axially and slidingly supports the moveable scroll body 194 with a thrust bearing 198, and at which the bearing portion 356 has a thrust surface 352 which faces to the moveable scroll body 194 and is in sliding contact with a sliding surface 354 of the moveable scroll body 194.

In the moveable scroll body 194 at least one passage 312*a* is formed which opens with an inlet 314 into an interior 168 of an receiving portion 264 of the hub 256.

The passage 312*a* extends from the inlet 314 to an outlet 316*a* at which the passage 312*a* opens into a hub environment 318.

In this embodiment the outlet 316*a* is arranged within an outer surface 336 of the base plate 214 of the moveable scroll body 194 at its second side 258 and in particular at least partly within the sliding surface 354.

With the outlet 316*a* being at least partly arranged within the sliding surface 354, the thrust surface 352 of the bearing portion 356 covers the outlet 316*a* during the orbiting motion of the moveable scroll body 194 along the orbital path at least temporarily and at least partly.

In some variations of the embodiment the outlet 316*a* is arranged such within the sliding surface 354 that during the entire orbital movement of the moveable scroll body 194 the thrust surface 352 covers the outlet 316*a* completely and/or partly.

In other variants of the embodiment the outlet 316*a* is arranged within the sliding surface 354 such that the thrust surface 352 covers the outlet 316*a* completely and/or partly during a part of the orbital movement of the moveable scroll body 194 and during the other part of the orbiting motion the outlet 316*a* is not covered by the thrust surface 352.

In variants of the embodiment, the passage 322*a* has a diameter which is essentially constant along the extension of the passage 312*a* from the inlet 314 to the outlet 316*a*.

In other variants of this or the above described embodiment, the passage 322*a* has a diameter which varies along the extension of the passage 312*a* from the inlet 314 to the outlet 316*a*.

In particular, the passage 312*a* has a first portion 382 which comprises the inlet 314 and extends in a direction 322 of extension of the passage 312*a* and the passage 312*a* has a second portion 384 which is closer to the outlet 316*a* than the first portion 382. For example, the second portion 384 extends to or at least close to the outlet 316*a*.

Both, the first portion 382 and the second portion 384, extend only partly along the entire extension of the passage 312*a* and for example a third portion 386 of the passage 312*a* is arranged between the first portion 382 and the second portion 384.

A diameter of the passage 312*a* is measured perpendicular to the direction 322 of extension of the passage 312*a* with the direction 322 of extension being directed from the inlet 314 to the outlet 316*a*.

The passage 312*a* has a diameter in the first portion 382 which is equal to or larger than a diameter D1.

Figure 7:
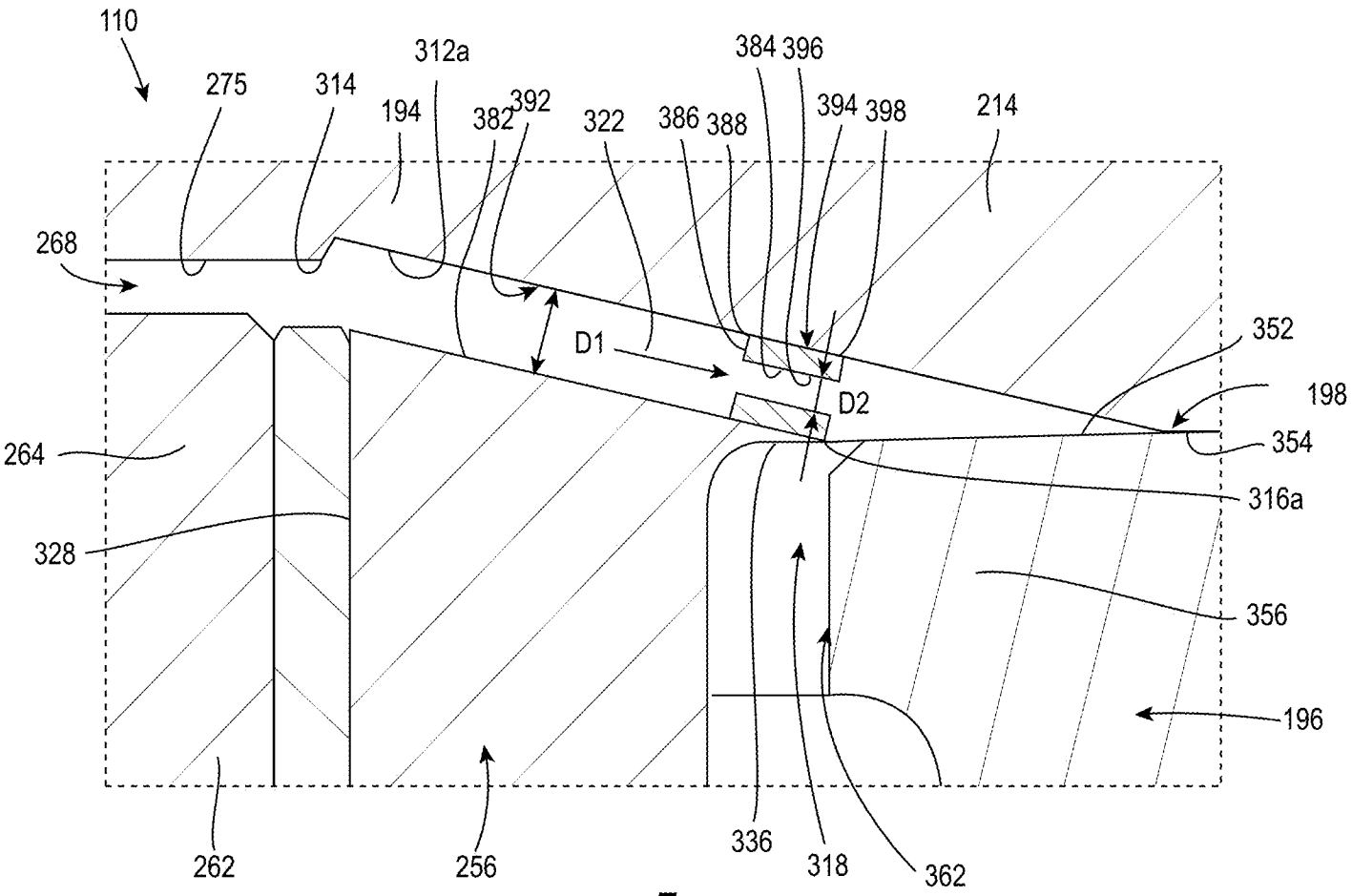
FIG. 7 shows a view similar to the one of FIG. 6 of another embodiment.

In particular, the diameter of the passage 312*a* within the entire first portion 382 is constant and equals to the diameter D1, as exemplarily shown in FIG. 7.

In a variant of the embodiment, the diameter of the passage 312*a* varies along the extension of the first portion 382 and in particular becomes smaller with increasing distance from the inlet 314. For example, at the inlet 314 the diameter is larger than the diameter D1 and the diameter of the passage 312*a* becomes preferably continuously smaller with increasing distance from an inlet 314 and attains the value D1 at the end of the first portion 182 opposite to the inlet 314.

The passage 312*a* has a diameter in the second portion 384 which is equal to or smaller to a diameter D2, which is smaller than the diameter D1.

In particular, the diameter of the passage 312*a* along the entire extension of the second portion 384 is constant and equals to the diameter D2, as exemplarily shown in FIG. 7.

In variants or the embodiment the diameter of the passage 312*a* varies along the extension of the second portion 384 and in particular becomes smaller with decreasing distance to the outlet 116*a*. For example, the diameter of the passage 312*a* equals to the diameter D2 at an end of the second portion 384 which is with respect to the direction of extension opposite to the outlet 316*a* and the diameter becomes preferably continuously smaller with decreasing distance to the outset 316*a*.

In particular, in the third portion 386 the diameter of the passage 312*a* changes from the diameter D1 to the diameter D2.

For example in the third portion 386 the passage 312*a* has a step 388 in its interior at which the diameter sharply changes from the diameter D1 to the diameter D2, as exemplarily shown in FIG. 7.

In variants of the embodiment, it is provided that in the third portion 386 the diameter of the passage 312*a* varies continuously from the diameter D1 to the diameter D2.

In yet another variant of the embodiment, which is not explicitly shown in the drawings, the diameter of the passage 312*a* in the third portion 386 is smaller than the diameter of the passage 312*a* in the first portion 382 and in the second portion 384.

In particular, in order to achieve the different diameters in the passage 312*a*, the moveable scroll body 194 is providing with a bore 392 which at least partly forms the passage 312*a* and the bore 392 has a constant diameter, for example a diameter D1, from the outlet 316*a* to the inlet 314 and at portions of the passage 312*a* with a diameter smaller than the constant diameter of the bore 392 an insert 394, for example an orifice or a nozzle, is arranged in the bore 392.

The insert 394 has a breakthrough 396 which has the diameter of the passage 312*a* and forms a portion of the passage 312*a*, in particular the second portion 384. In particular, an outer side 398 of the insert 394 is in contact with a wall of the bore 392.

In all other respects, the compressor of the present embodiment is preferably at least partly, in particular at least essentially the same as the scroll compressor 110 of the first embodiment such that reference is made fully to the explanations provided above, in particular with respect to further advantageous features of the passage and/or of the hub 256 and/or of the receiving portion 264 and in particular of a receiving chamber 282 in its interior 268 and for example of a bushing 277 between the drive section 262 and a hub wall 266 and/or of a compression unit which comprises the two scroll bodies and/or of a shaft 152 for example with a lubricant passage way and/or of a drive unit of the scroll compressor and/or of a fluid path for the gaseous medium through the compressor housing.

REFERENCE NUMERALS

110 scroll compressor
112 compressor housing
114 inlet port
116 outlet port
120 compression unit
122 drive unit
124 drive casing
136 intake area
138 discharge chamber
152 shaft
154 shaft axis
156 upper bearing support
158 lower bearing support
162 direction of gravitation
166 stator
168 rotor
172 lubricant sump
174 bottom of housing
176 input section
178 lubricant passage way
182 output opening
192 stationary scroll body
193 holding member
194 moveable scroll body
196 support member
198 thrust bearing
212 base plate of stationary scroll body
214 base plate of moveable scroll body
216 base plane

218 base plane
222 side of stationary scroll body
224 first side of moveable scroll body
226 scroll rib of stationary scroll body
228 scroll rib of movable scroll body
232 compression chamber
236 sealing element
238 sealing element
244 central axis of moveable scroll body
246 central axis of stationary scroll body
248 orbital path
252 rotation direction
256 hub
258 second side of moveable scroll body
262 eccentric offset drive section
264 receiving portion
266 hub wall
268 interior
272 opening
273 opening side
274 bottom of receiving portion
275 bottom surface
276 axis of drive section
277 bushing
278 axial end
282 receiving chamber
312 passage
314 inlet
316 outlet
318 hub environment
322 direction of extension
326 edge in receiving portion
327 end region of inner cylindrical surface
328 inner cylindrical surface
332 outer cylindrical surface
336 outer surface
337 end region of outer cylindrical surface
338 outer edge
352 thrust surface
354 sliding surface
355 inner radial end of sliding surface
356 bearing portion
357 outer radial end of sliding surface
362 breakthrough
364 radially inner surface
366 gap
368 transition surface
372 void space
382 first portion
384 second portion
386 third portion
388 step
392 bore
394 insert
396 breakthrough
398 outer side

What is claimed is:

1. A scroll compressor comprising:

two scroll bodies each having a scroll rib and the scroll ribs engage each other to form at least one compression chamber;

a drive shaft for driving a moveable scroll body of the two scroll bodies; and a thrust bearing, wherein the moveable scroll body comprises:

a base plate which has two opposing sides, wherein, on a first side of the two opposing sides, the scroll rib is arranged and, on a second side of the two opposing sides, a hub is arranged;

wherein the hub comprises a receiving portion for a drive section of the drive shaft, and wherein the moveable scroll body comprises at least one passage from an interior of the receiving portion to a hub environment located around the hub at the second side of the two opposing sides;

wherein an outlet of the at least one passage is arranged, at least partly, within a sliding surface on the second side of the base plate of the moveable scroll body for the thrust bearing;

wherein the outlet of the at least one passage is positioned in an axial direction with respect to an axis of the receiving portion, closer to an opening side of the hub in which an opening of the receiving portion is arranged than an inlet of the at least one passage; and wherein the at least one passage exits the interior of the receiving portion inclined to a radial direction at the inlet with respect to a central axis of the moveable scroll body.

2. The scroll compressor according to claim 1, wherein the inlet of the at least one passage is provided in an end region of the interior of the receiving portion opposite in an axial direction of an axis of the receiving portion to an opening of the receiving portion for the drive section.

3. The scroll compressor according to claim 1, wherein the at least one passage exits the interior of the receiving portion at the inlet of the at least one passage inclined to a radial direction with respect to an axis of the receiving portion.

4. The scroll compressor according to claim 1, wherein the inlet of the at least one passage is arranged at an edge where an inner cylindrical surface of the receiving portion and a bottom surface of the interior of the receiving portion intersect.

5. The scroll compressor according to claim 1, wherein the outlet of the at least one passage is arranged adjacent to an outer surface of the base plate of the moveable scroll body at its second side with the outer surface surrounding the hub.

6. The scroll compressor according to claim 1, wherein the outlet of the at least one passage is provided closer to a radially inner end of an outer surface of the base plate than to a radially outer end of the outer surface of the base plate at the second side.

7. The scroll compressor according to claim 1, wherein the outlet of the at least one passage is provided closer to a radially inner end of the sliding surface at the second side of the base plate than to a radially outer end of the sliding surface at the second side of the base plate of the moveable scroll body for the thrust bearing.

8. The scroll compressor according to claim 1, wherein the at least one passage extends straight along a direction of extension from the inlet to the outlet.

9. The scroll compressor according to claim 1, wherein the inlet of the at least one passage opens into a receiving chamber for a lubricant in the interior of the receiving portion.

10. The scroll compressor according to claim 9, wherein the drive shaft provides a lubricant passage way connecting a lubricant sump with the interior of the receiving portion and the lubricant passage way opens into the receiving chamber in the interior.

11. The scroll compressor according to claim 1, wherein the outlet of the at least one passage is provided in a radial direction farther to a central axis of the moveable scroll body than to a radially inner side of the thrust bearing provided by a support member which supports the moveable scroll body.

12. The scroll compressor according to claim 1, wherein the scroll compressor further comprises a support member which provides the thrust bearing that supports the moveable scroll body and the support member has a breakthrough for the hub and/or for the drive shaft and the support member has a slanted edge at its radial inner side at an axial end of the breakthrough facing towards the moveable scroll body and the outlet of the at least one passage faces towards the slanted edge.

13. The scroll compressor according to claim 1, wherein the outlet of the at least one passage is arranged at an outer surface of the base plate of the moveable scroll body on the second side with the outer surface surrounding the hub.

14. The scroll compressor according to claim 1, wherein the outlet of the at least one passage is arranged at the sliding surface on the second side of the base plate of the moveable scroll body for the thrust bearing.

15. A scroll compressor comprising:

two scroll bodies each having a scroll rib and the scroll ribs engage each other to form at least one compression chamber;

a drive shaft for driving a moveable scroll body of the two scroll bodies; and a thrust bearing, wherein the moveable scroll body comprises:

a base plate which has two opposing sides, wherein, on a first side of the two opposing sides, the scroll rib is arranged and, on a second side of the two opposing sides, a hub is arranged; and at least one passage including an inlet and an outlet, the inlet formed at an interior of a receiving portion of the hub and extending to a hub environment located around the hub at the second side of the two opposing sides, and the at least one passage has a first diameter and a second diameter smaller than the first diameter, the second diameter having an inclined, spaced relationship relative to the outlet while having direct communication with the outlet, wherein the outlet of the at least one passage is arranged, at least partly, within a sliding surface on the second side of the base plate of the moveable scroll body for the thrust bearing; and wherein the inlet of the at least one passage is arranged at an inner cylindrical surface of the receiving portion.

16. The scroll compressor according to claim 15, wherein a bottom surface of the receiving portion is in an axial direction offset to an outer surface of the base plate of the moveable scroll body at its second side and the outer surface surrounds the hub and the inlet of the at least one passage is located within an axial offset section which extends from the axial position of the bottom surface of the receiving portion to the axial position of the outer surface, the axial direction being with respect to the axis of the receiving portion.

17. The scroll compressor according to claim 15, wherein the at least one passage is arranged with increasing radial distance from the inlet towards the outlet in an axial direction of the hub, the outlet being positioned closer to an opening side of the hub than the inlet.

18. The scroll compressor according to claim 15, wherein the at least one passage is provided entirely in the base plate of the orbiting scroll adjacent to a hub wall of the hub.

19. The scroll compressor according to claim 15, wherein the outlet of the at least one passage is provided with respect to a central axis of the moveable scroll body at an axial position which is at least approximately the same as an axial position of the thrust bearing provided by a support member which supports the moveable scroll body.

20. A scroll compressor comprising:

two scroll bodies each having a scroll rib and the scroll ribs engage each other to form at least one compression chamber;

a drive shaft for driving a moveable scroll body of the two scroll bodies; and a thrust bearing, wherein the moveable scroll body comprises:

a base plate which has two opposing sides, wherein, on a first side of the two opposing sides, the scroll rib is arranged and, on a second side of the two opposing sides, a hub is arranged;

wherein the hub comprises a receiving portion for a drive section of the drive shaft, and wherein the moveable scroll body comprises at least one passage from an interior of the receiving portion to a hub environment located around the hub at the second side of the two opposing sides;

wherein an outlet of the at least one passage is arranged, at least partly, within a sliding surface on the second side of the base plate of the moveable scroll body for the thrust bearing; and wherein the at least one passage is arranged along its entire extension from an inlet to the outlet, oblique to a radial direction and an axial direction, the radial and the axial direction being with respect to an axis of the receiving portion.

21. A scroll compressor comprising:

two scroll bodies each having a scroll rib and the scroll ribs engage each other to form at least one compression chamber;

a support member including a thrust bearing;

a drive shaft for driving a moveable scroll body of the two scroll bodies, wherein the moveable scroll body comprises:

a base plate which has two opposing sides, wherein, on a first side of the two opposing sides, the scroll rib is arranged and, on a second side of the two opposing sides, a hub is arranged;

wherein the hub comprises a receiving portion for a drive section of the drive shaft, and wherein the moveable scroll body comprises at least one passage from an interior of the receiving portion to a hub environment located around the hub at the second side of the two opposing sides;

wherein an outlet of the at least one passage is arranged, at least partly, within a sliding surface on the second side of the base plate of the moveable scroll body for the thrust bearing; and wherein an inlet of the at least one passage is provided between an axial end surface of the drive section and a bottom surface of the receiving portion and a first portion of the outlet is at least temporarily overlying the thrust bearing during a cycle of the orbiting scroll and a second portion of the outlet is at least temporarily overlying a void space of a breakthrough of the support member positioned between the hub and the support member during the cycle of the orbiting scroll.

22. A scroll compressor comprising:

two scroll bodies each having a scroll rib and the scroll ribs engage each other to form at least one compression chamber;

a drive shaft for driving a moveable scroll body of the two scroll bodies; and a thrust bearing, wherein the moveable scroll body comprises:

a base plate which has two opposing sides, wherein, on a first side of the two opposing sides, the scroll rib is arranged and, on a second side of the two opposing sides, a hub is arranged;

wherein the hub comprises a receiving portion for a drive section of the drive shaft, and wherein the moveable scroll body comprises at least one passage from an interior of the receiving portion to a hub environment located around the hub at the second side of the two opposing sides;

wherein an outlet of the at least one passage is arranged, at least partly, within a sliding surface on the second side of the base plate of the moveable scroll body for the thrust bearing; and wherein the outlet of the at least one passage opens into a breakthrough of a support member which supports the moveable scroll body.

23. The scroll compressor according to claim 22, wherein the support member provides the thrust bearing that supports the moveable scroll body and adjacent to the thrust bearing a void space between an outer surface of the base plate of the moveable scroll body at the side with the hub and the support member is formed which opens into a breakthrough of the support member for the hub and/or for the drive shaft.

* * * * *